US008319809B2

(12) United States Patent
Nakagawa et al.

(10) Patent No.: US 8,319,809 B2
(45) Date of Patent: Nov. 27, 2012

(54) RECORDING HEAD AND RECORDING DEVICE

(75) Inventors: Hidenobu Nakagawa, Kirishima (JP); Yoichi Moto, Kirishima (JP); Sunao Hashimoto, Soraku-gun (JP)

(73) Assignee: Kyocera Corporation, Kyoto (JP)

( * ) Notice: Subject to any disclaimer, the term of this patent is extended or adjusted under 35 U.S.C. 154(b) by 326 days.

(21) Appl. No.: 12/865,621

(22) PCT Filed: Dec. 24, 2008

(86) PCT No.: PCT/JP2008/073454

§ 371 (c)(1),
(2), (4) Date: Jul. 30, 2010

(87) PCT Pub. No.: WO2009/096127

PCT Pub. Date: Aug. 6, 2009

(65) Prior Publication Data

US 2011/0007121 A1 Jan. 13, 2011

(30) Foreign Application Priority Data

Jan. 31, 2008 (JP) ..... 2008-020268

(51) Int. Cl.
*B41J 2/335* (2006.01)

(52) U.S. Cl. ..... 347/208

(58) Field of Classification Search ..... 347/200, 347/202, 208

See application file for complete search history.

(56) References Cited

U.S. PATENT DOCUMENTS 4,259,564 A * 3/1981 Ohkubo et al. ..... 347/208

FOREIGN PATENT DOCUMENTS

| | | | |
|---|---|---|---|
| JP | 52-135745 | A | 11/1977 |
| JP | 57-144770 | A | 9/1982 |
| JP | 58-087077 | A | 5/1983 |
| JP | 5-246065 | A | 9/1993 |

OTHER PUBLICATIONS

Computer-generated translation of JP 5-246065, published on Sep. 1993.*

Official Action of corresponding Japanese Patent Application No. 2009-551410.

* cited by examiner

*Primary Examiner* — Huan Tran

(74) *Attorney, Agent, or Firm* — Birch, Stewart, Kolasch & Birch, LLP

(57) ABSTRACT

A recording head applicable to a recording device is disclosed. The recording head comprises a substrate, a conductive pattern layer, and an electric resistor layer. The conductive pattern layer is formed on the substrate and comprises a first conductive portion, a second conductive portion, and an insulating portion. The second conductive portion is paired with the first conductive portion. The insulating portion insulates the first conductive portion and the second conductive portion. The electrical resistance layer: is formed on the conductive pattern layer; is connected to the first conductive portion and the second conductive portion; and comprises a heat-generating region between the first conductive portion and the second conductive portion.

13 Claims, 28 Drawing Sheets

RECORDING HEAD AND RECORDING DEVICE

CROSS-REFERENCE TO RELATED APPLICATION

The present application is a continuation in part based on PCT Application No. JP2008/073454, filed on Dec. 24, 2008, which claims the benefit of Japanese Application No. 2008-020268, filed on Jan. 31, 2008 both entitled "RECORDING HEAD AND RECORDING DEVICE USING SAME". The contents of which are incorporated by reference herein in their entirety.

FIELD

Embodiments of the present disclosure relate generally to recording heads, and more particularly relate to a recording head applicable to recording devices.

BACKGROUND

For a recording device such as a facsimile machine, for example, a thermal printer comprising a thermal head and a platen roller may be used. Thermal heads mounted on such a thermal printer comprise a substrate, a plurality of heat-generating portions arranged on the substrate, an electrode pattern for supplying power to the heat-generating portions, and a protective layer covering the heat-generating portions and the electrode pattern. Such a thermal printer can make a print by sliding and pressing a recording medium against the protective layer located on the heat-generating portions with the platen roller.

Such thermal heads comprise one or more steps on the surface of the protective layer. The steps are made by projecting the electrode pattern from the substrate. When the recording medium is slid and pressed against the protective layer having a step on the surface in such a manner, variations in the frictional force between the protective layer and the recording medium may be caused, resulting in wrinkling of the recording medium.

At the same time, when irregularities on the protective layer are smoothed to address problems due to wrinkling as described above, the overall thickness of the layer formed on the heat-generating portions will be thickened. A thermal head with such a configuration may require more time to transfer the heat generated by the heat-generating portions to the recording medium. Therefore, there is a need for recording heads that provide an improved image.

SUMMARY

A recording head applicable to a recording device is disclosed.

A first embodiment comprises a recording head. The recording head comprises a substrate, a conductive pattern layer, and an electric resistor layer. The conductive pattern layer is formed on the substrate and comprises a first conductive portion, a second conductive portion, and an insulating portion. The second conductive portion is paired with the first conductive portion. The insulating portion insulates the first conductive portion and the second conductive portion. The electrical resistance layer: is formed on the conductive pattern layer; is connected to the first conductive portion and the second conductive portion; and comprises a heat-generating region between the first conductive portion and the second conductive portion.

A second embodiment comprises a recording device. The recording device comprises: an abovementioned recording head; and a conveying mechanism. The conveying mechanism comprises a conveying mechanism for conveying a recording medium onto the heat-generating region of the recording head.

BRIEF DESCRIPTION OF THE DRAWINGS

Embodiments of the present disclosure are hereinafter described in conjunction with the following figures, wherein like numerals denote like elements. The figures are provided for illustration and depict exemplary embodiments of the disclosure. The figures are provided to facilitate understanding of the disclosure without limiting the breadth, scope, scale, or applicability of the disclosure. The drawings are not necessarily made to scale.

DETAILED DESCRIPTION

The following description is presented to enable a person of ordinary skill in the art to make and use the embodiments of the disclosure. The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. Furthermore, there is no intention to be bound by any expressed or implied theory presented in the preceding technical field, background, brief summary or the following detailed description. The present disclosure should be accorded scope consistent with the claims, and not limited to the examples described and shown herein.

Embodiments of the disclosure are described herein in the context of practical non-limiting applications, namely, recording heads. Embodiments of the disclosure, however, are not limited to such recording heads, and the techniques described herein may also be utilized in other filter applications. For example, embodiments are not limited to a recording head and may be applicable to a thermal head, an ink jet head, and the like used in a recording device such as a facsimile machine, a barcode printer, a video printer or a digital photo printer.

As would be apparent to one of ordinary skill in the art after reading this description, these are merely examples and the embodiments of the disclosure are not limited to operating in accordance with these examples. Other embodiments may be utilized and structural changes may be made without departing from the scope of the exemplary embodiments of the present disclosure.

Figure 1:
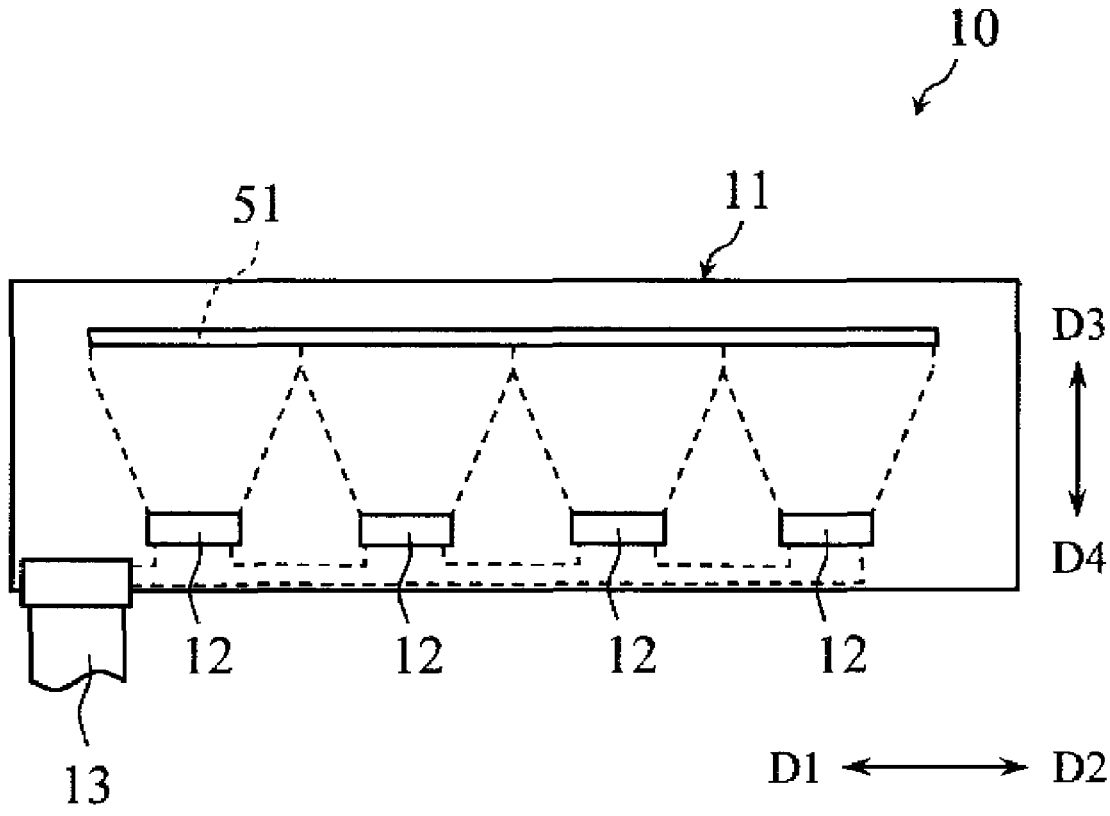
FIG. 1 is a plan view schematically illustrating a thermal head according to an embodiment of the present disclosure.
Figure 2:
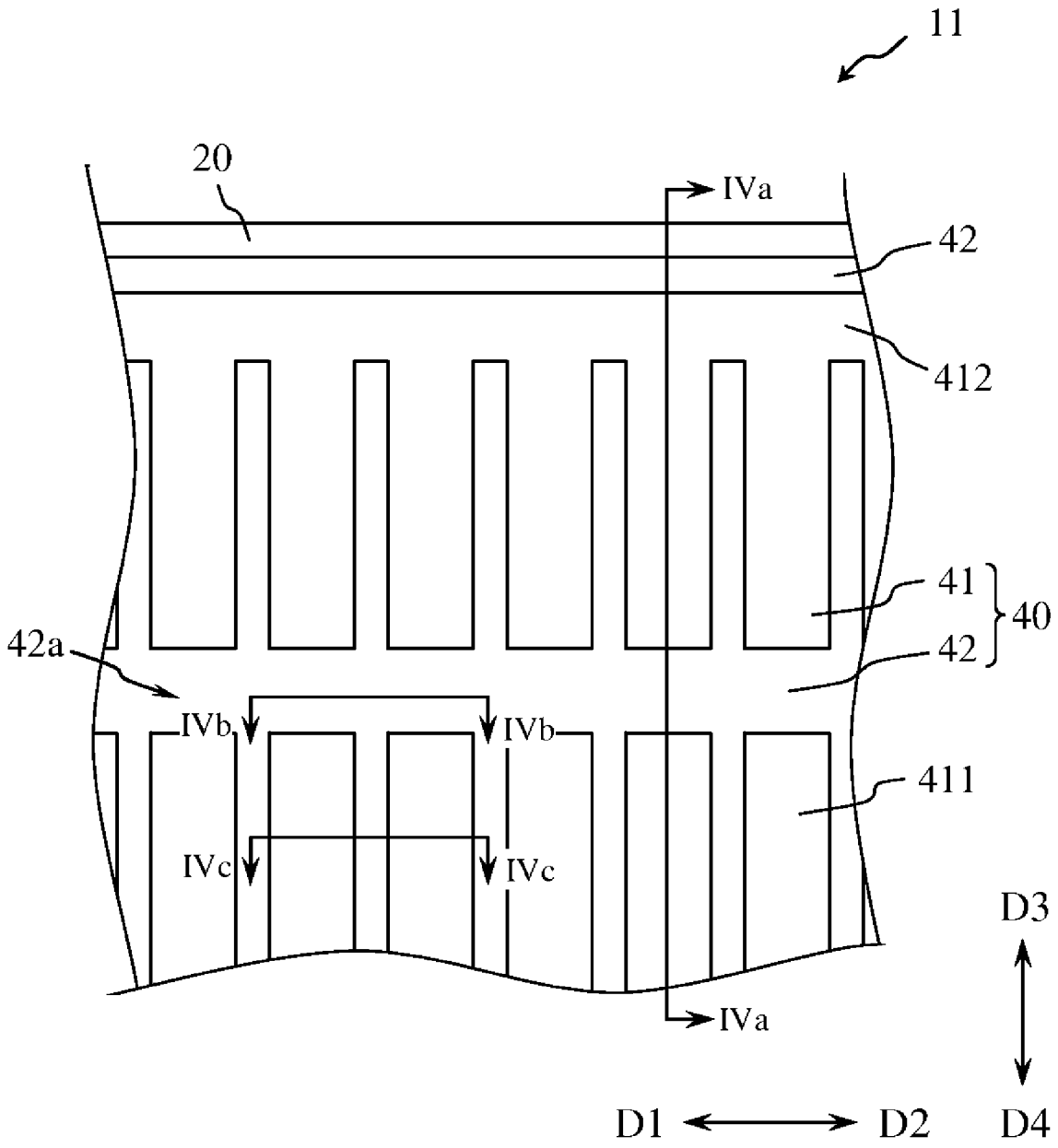
FIG. 2 is a plan view schematically illustrating the base substance shown in FIG. 1.
Figure 3:
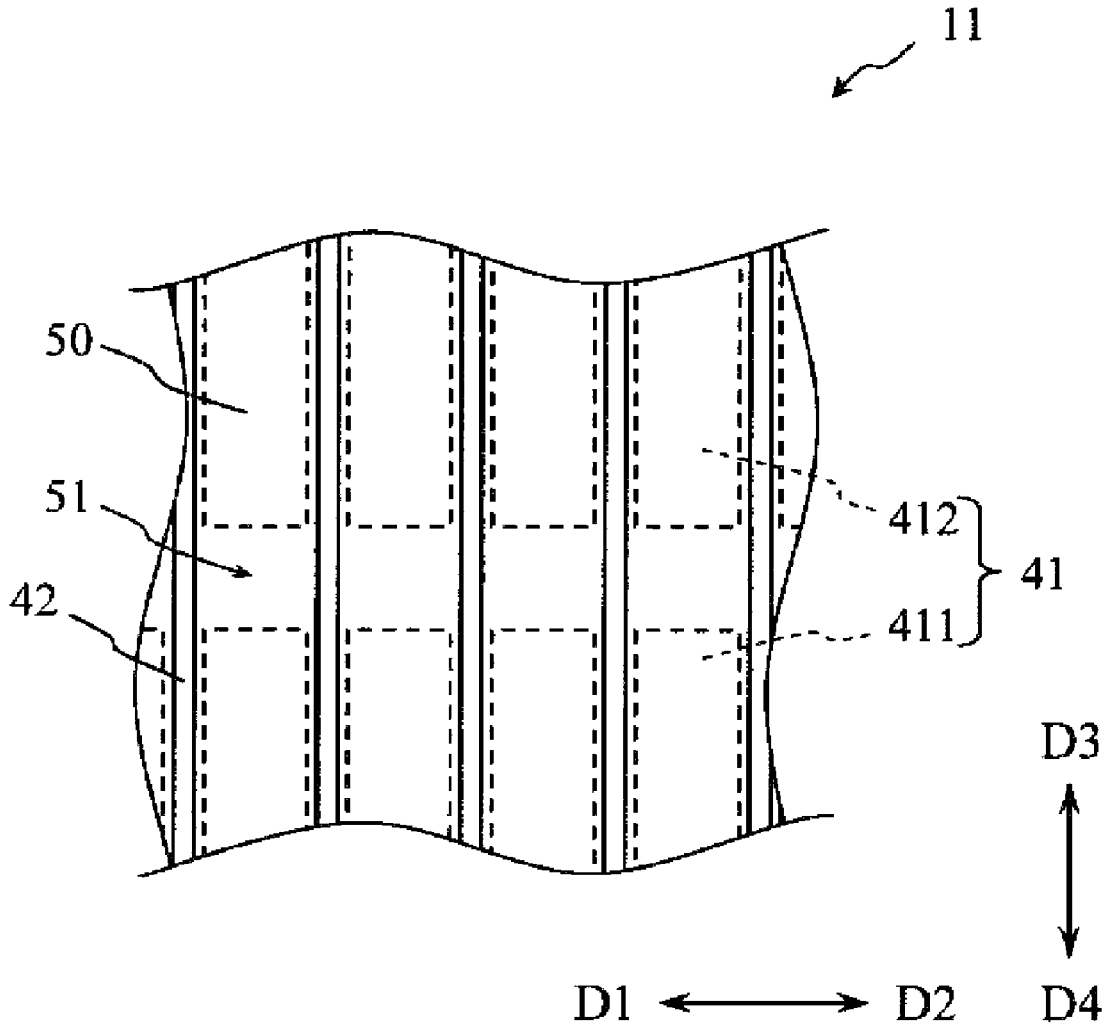
FIG. 3 is an extended view illustrating the substantial parts shown in FIG. 2.
Figure 4A:
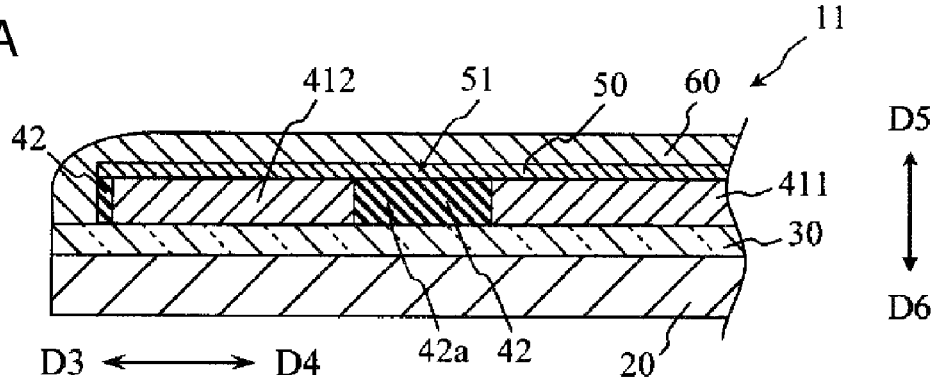
FIG. 4A is a cross-sectional view along the line IVa-IVa shown in FIG. 2.
Figure 4B:
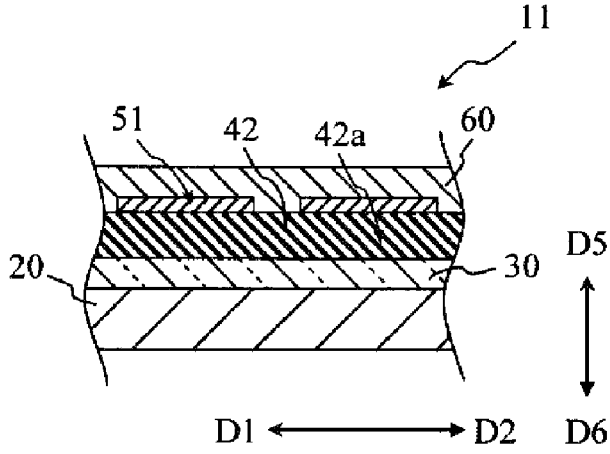
FIG. 4B is a cross-sectional view along the line IVb-IVb shown in FIG. 2.
Figure 4C:
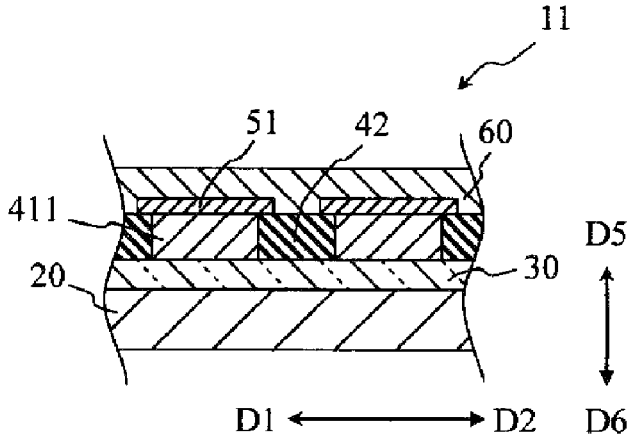
FIG. 4C is a cross-sectional view along the line IVc-IVc shown in FIG. 2.

FIG. 1 is a plan view schematically illustrating a thermal head according to an embodiment of the present disclosure. FIG. 2 is a plan view schematically illustrating the base substance shown in FIG. 1. FIG. 3 is an extended view illustrating the substantial parts shown in FIG. 2. FIG. 4A is a cross-sectional view along the line IVa-IVa shown in FIG. 2. FIG. 4B is a cross-sectional view along the line IVb-IVb shown in FIG. 2. FIG. 4C is a cross-sectional view along the line IVc-IVc shown in FIG. 2.

According to an embodiment of the present disclosure, a thermal head 10 may comprise a base substance 11, a driver IC 12, and an external connection member 13. In the thermal head 10, a site forming a heat-generating region of the base substance 11 in response to image information supplied via the external connection member 13 can generate heat.

The base substance 11 may comprise a substrate 20, a heat storage layer 30, a conductive pattern layer 40, an electrical resistance layer 50, and a protective layer 60. The electrical resistance layer 50 comprises a heat-generating portion 51 that forms the heat-generating region of the base substance 11. Note that the electrical resistance layer 50 and the protective layer 60 are omitted from FIG. 2 and the protective layer 60 is omitted from FIG. 3 for understanding easily.

The substrate 20 may function as a supporting base material for the heat storage layer 30, the conductive pattern layer 40, the electrical resistance layer 50, the protective layer 60, and the like. The substrate 20 may comprise ceramic materials such as alumina ceramics, resin materials such as epoxy-based resins and silicon-based resins, and insulating materials such as silicon materials and glass materials. In the present embodiment, the substrate 20, for example and without limitation, comprises or consists essentially of alumina ceramics.

The heat storage layer 30 may be provided over the entire top surface of the substrate 20 on the side of the direction of an arrow D5. The heat storage layer 30 has functions of accumulating part of the Joule heat generated in the heat-generating portion 51 and maintaining the good thermal response characteristics of the thermal head 10. That is, the heat storage layer 30 contributes to raising the temperature of the heat-generating portion 51 to a predetermined temperature required for printing in a short time. The heat storage layer 30 may comprise resin materials such as epoxy-based resins and polyimide-based resins and insulating materials such as glass materials. In addition, the heat storage layer 30 is formed on the substrate 20 with a generally flat shape.

The conductive pattern layer 40 is located on the heat storage layer 30. The conductive pattern layer 40 contributes to supplying power to the heat-generating portion 51. In addition, the conductive pattern layer 40 may comprise a conductive portion 41 and an insulating portion 42. Furthermore, the conductive pattern layer 40 is formed as a single layer and has a generally flat top surface on the side of the direction of the arrow D5. The top surface on the side of the direction of the arrow D5 faces the conductive portion 41 and the insulating portion 42. Here, the term "generally flat" refers to a state in which the difference in height in the arrowed directions D5, D6 with respect to the average thickness in the arrowed directions D5, D6 is within ±5%. The conductive pattern layer 40 is formed with a thickness between 0.5 (μm) and 2.0 (μm), for example.

The conductive portion 41 functions as a power supply line that contributes to supplying power to the heat-generating portion 51. The conductive portion 41 may comprise a first portion 411 and a second portion 412. In addition, the conductive portion 41 comprises, for example and without limitation, a conductive material mainly composed of metal. The conductive material may comprise aluminum, copper, and alloys thereof. Here, the term "mainly" refers to having the highest mole fraction of constituent atoms, and additives, for example, may be contained. In addition, in the conductive portion 41, the upper and lower surfaces in the arrowed directions D5, D6 configure part of the upper and lower surfaces in the arrowed directions D5, D6 of the conductive pattern layer 40. That is, the conductive portion 41 may penetrate the conductive pattern layer 40 in the arrowed directions D5, D6.

The first portion 411 is a site that contributes to supplying power to the heat generating portion 51. One end of the first portion 411 on the side of the direction of the arrow D3 is connected to one end of the heat-generating portion 51, and the driver IC 12 is connected to the other end on the side of the direction of the arrow D4. The first portion 411 is electrically connected to a reference potential point (i.e., ground) via the driver IC 12.

The second portion 412 is a site that contributes to supplying power to the heat-generating portion 51 by making a pair with the first portion 411. A plurality of other ends of the heat-generating portion 51 and a power source (not shown) are electrically connected to one end of the second portion 412.

The insulating portion 42 has functions of insulating the first portion 411 and the second portion 412. The insulating portion 42 is provided between the first portion 411 and the second portion 412 paired with the first portion 411 and is also extended and provided between the first portions 411 and between the second portions 412. That is, the insulating portion 42 surrounds the first portion 411 and the second portion 412 and is formed in a state in which it comes into contact with the sides of the first portion 411 and the second portion 412. In addition, in the insulating portion 42, the upper and lower surfaces in the arrowed directions D5, D6 configure part of the upper and lower surfaces in the arrowed directions D5, D6 of the conductive pattern layer 40. That is, the insulating portion 42 may penetrate the conductive pattern layer 40 in the arrowed directions D5, D6. The insulating portion 42 of the present embodiment comprises a metallic oxide that mainly forms the conductive portion 41. Furthermore, in the insulating portion 42 of the present embodiment, the conductive portion 41 and the insulating portion 42 are integrally formed by oxidizing part of the metal of the conductive portion 41 located in the site where the insulating portion 42 is formed. The insulating portion 42 may have a higher hardness and a lower thermal conductivity than the conductive material configuring the conductive portion 41. Here, the term "insulation" refers to insulation of a degree such that the flow of electric current is substantially prevented. The degree such that the flow of electric current is substantially prevented refers to, for example, resistivity of $1.0\times10^{10}$ (Ω-cm) or more. In addition, here, the term "hardness" refers to Shore hardness, which is specified in JIS (Japanese Industrial Standards) Z2246: 2000.

The electrical resistance layer 50 may comprise a plurality of the heat-generating portions 51 serving as a heat-generating region. The electrical resistance layer 50 is located on the conductive pattern layer 40. In addition, the electrical resistance layer 50 is provided across the first portion 411 through the second portion 412 paired with the first portion 411 and covers a partial region 42*a* of the insulating portion 42 located between the first portion 411 and the second portion 412.

The electrical resistance layer 50 may be located on the partial region 42*a* and serve as the heat-generating portion 51. Furthermore, the electrical resistance layer 50 may cover the first portion 411 and the second portion 412, and an end thereof extends onto the insulating portion 42. The electrical resistance layer 50 has the electrical resistivity per unit length greater than the electrical resistivity per unit length of the first portion 41 and the second portion 42. The electrical resistance layer 50 comprises, without limitation, TaSiO-based materials, TaSiNO-based materials, TiSiO-based materials, TiSiCO-based materials, and NbSiO-based materials. In addition, the electrical resistance layer 50 may have a lower average thickness than the conductive pattern layer 40. Here, the average thickness refers to the arithmetic average of the maximum thickness and the minimum thickness. The thickness of the electrical resistance layer 50 may be between 0.01 (μm) and 0.5 (μm), for example.

The heat-generating portion 51 serves as a heat-generating region where the heat is generated through the application of voltage using the conductive pattern layer 40. The temperature of the heat generated by the heat-generating portion 51 may be, for example and without limitation, between 200° C. and 550° C. In the present embodiment, a plurality of heat-generating portions 51 is arranged at even intervals in the arrowed directions D1, D2. The arrangement direction of the heat-generating portion 51 forms the main scanning direction of the thermal head 10.

The protective layer 60 can protect the conductive pattern layer 40 and the electrical resistance layer 50. That is, the protective layer 60, for example, protects the conductive portion 41 from contact with the atmosphere to reduce corrosion caused by atmospheric moisture or the like. The protective layer 60 may comprise diamond-like carbon materials, SiC-based materials, SiN-based materials, SiCN-based materials, SiON-based materials, SiONC-based materials, SiAlON-based materials, $SiO_2$-based materials, $Ta_2O_5$-based materials, TaSiO-based materials, TiC-based materials, TiN-based materials, $TiO_2$-based materials, $TiB_2$-based materials, AlC-based materials, AlN-based materials, $Al_2O_3$-based materials, ZnO-based materials, $B_4C$-based materials, and BN-based materials. Here, the term "diamond-like carbon materials" refers to film in which the proportion of carbon atoms (C atoms) with an $sp^3$ hybrid orbital is between 1% by atom or more and less than 100% by atom. In addition, here, the term "materials mainly formed of X-based materials" refers to materials in which the main material constitutes 50% by mass or more of the total, and additives, for example, may be contained. The protective layer 60 can be formed by a sputtering method.

The driver IC 12 can selectively control heat generation of each of a plurality of heat-generating portions 51. It may be electrically connected to the first portion 411 and the external connection member 13. The driver IC 12 selectively controls heat generation of the heat-generating portion 51 by selectively switching the electrical connection of the heat-generating portion 51 and the reference potential based on image information supplied via the external connection member 13.

The external connection member 13 can input electric signals driving the heat-generating portion 51 into the thermal head 10.

The thermal head 10 may comprise the conductive pattern layer 40 comprising the conductive portion 41 and the insulating portion 42, and a conductive pattern comprises not only the conductive portion 41 but also the insulating portion 42 for insulating the conductive portion 41. As a result, in the thermal head 10, the degree of irregularity at the top surface due to the thickness of the conductive portion 41 can be reduced. Therefore, in the thermal head 10, the generation of wrinkles on a recording medium can be reduced even when, for example, the recording medium is conveyed and pressed with a platen roller.

In addition, in the thermal head 10, because the electrical resistance layer 50 is located on the conductive pattern layer 40, the heat generated at the heat-generating portion 51 can be transferred efficiently to the topmost surface layer side of the thermal head 10 compared to cases in which, for example, the electrical resistance layer 50 is located under the conductive pattern layer 40.

In the thermal head 10 where the insulating portion 42 of the conductive pattern layer 40 extends between the conductive portions 41, the degree of irregularity at the topmost surface due to the thickness of the conductive portion 41 can be reduced even further.

In the thermal head 10 where the conductive portion 41 is surrounded by the substrate 20, the insulating portion 42, and the electrical resistance layer 50, the electrical resistance layer 50 and the insulating portion 42 can reduce corrosion of the conductive portion 41.

In the thermal head 10 where the hardness of the partial region 42*a* of the insulating portion 42 is greater than the hardness of the conductive portion 41, dispersion of pressing force can be reduced and the heat generated at the heat-generating portion 51 can be transferred efficiently to a recording medium even if, for example, the recording medium is conveyed and pressed with a platen roller onto the partial region 42*a* of the insulating portion 42.

In thermal head 10 where the average thickness of the electrical resistance layer 50 is lower than the average thickness of the conductive portion 41, the degree of irregularity at the topmost surface due to the formation of the electrical resistance layer 50 on the conductive pattern layer 40 can be reduced.

In the thermal head 10 comprising the insulating portion 42 obtained by oxidizing the conductive material which mainly configures the conductive portion 41, the insulating portion 42 has higher adhesion to the conductive portion 41 compared to the protective layer 60, and therefore, the conductive portion 41 can be protected well.

The method of manufacturing the thermal head 10 according to the present embodiment is described below in conjunction with FIG. 5. In the present embodiment, descriptions are made by employing aluminum as the component material of the conductive portion 41. FIGS. 5A to 5E are cross-sectional views of the substantial parts illustrating a series of processes of a method of manufacturing the thermal head shown in FIG. 1.

Figure 5A:
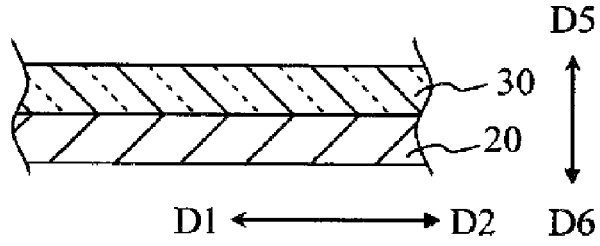
FIGS. 5A-E are cross-sectional views of the substantial parts illustrating a series of processes of a method of manufacturing the thermal head shown in FIG. 1.

As shown in FIG. 5A, first, the substrate 20 is prepared, and the heat storage layer 30 is formed thereon. Specifically, the heat storage layer 30 with a generally flat shape is formed on the substrate 20 through a film forming technique such as sputtering.

Figure 5B:
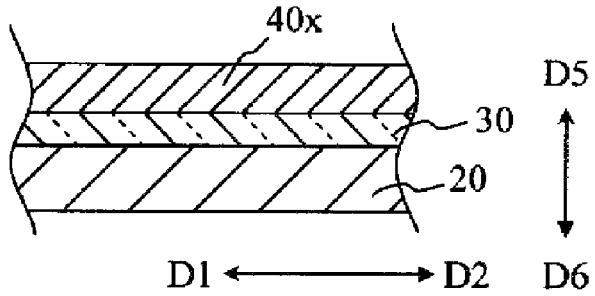

As shown in FIG. 5B, a conductive film 40*x* is formed on the heat storage layer 30 formed on the substrate 20. Specifically, the conductive film 40*x* is formed by forming an aluminum film with a generally flat shape on the substrate 20 through a film forming technique such as sputtering or vapor deposition.

Figure 5C:
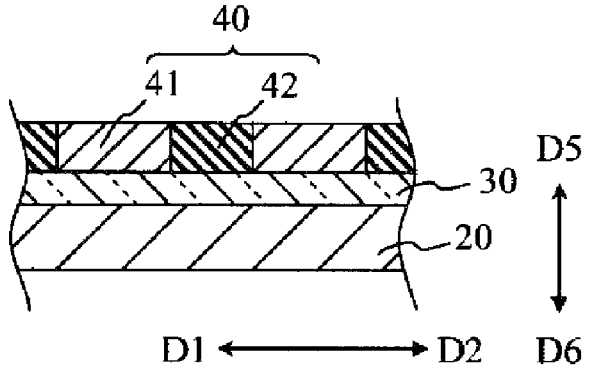

As shown in FIG. 5C, the conductive pattern layer 40 is formed on the heat storage layer 30. Specifically, first, a mask is formed on the conductive film 40*x* through a fine processing technique such as photolithography. Next, it is processed so that part of the conductive film 40*x* located on the region where the insulating portion 42 is formed is exposed from the mask through a fine processing technique such as photolithography. Then, part of the exposed conductive film 40*x* is anodized to form the insulating portion 42. Accordingly, the conductive layer 40, in which another portion of the conductive film 40*x* remaining without being anodized functions as the conductive portion 41, can be formed. In the anodization, the conductive film 40*x* is soaked in solution and a positive voltage is applied to the conductive film 40 while a negative voltage is applied to the solution. Examples of the solutions comprise an electrolyte such as phosphoric acid, boric acid, oxalic acid, tartaric acid, and sulfuric acid.

Figure 5D:
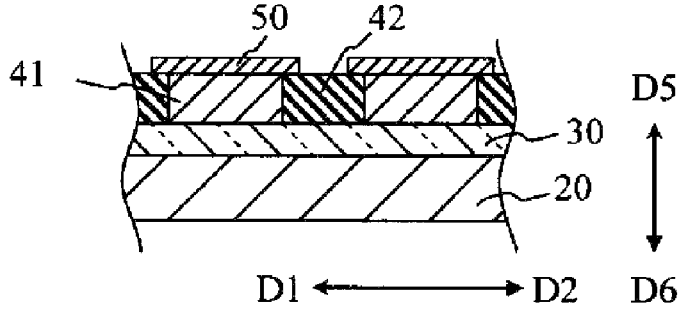

As shown in FIG. 5D, the electrical resistance layer 50 is formed on the conductive pattern layer 40. Specifically, first, a resistor film is formed through a film forming technique such as sputtering or vapor deposition. Then, it is processed into a pattern in which the resistor film covers the conductive portion 41 and the partial region 42*a* of the insulating portion 42 and the electrical resistance layer 50 is formed through a fine processing technique such as photolithography.

Figure 5E:
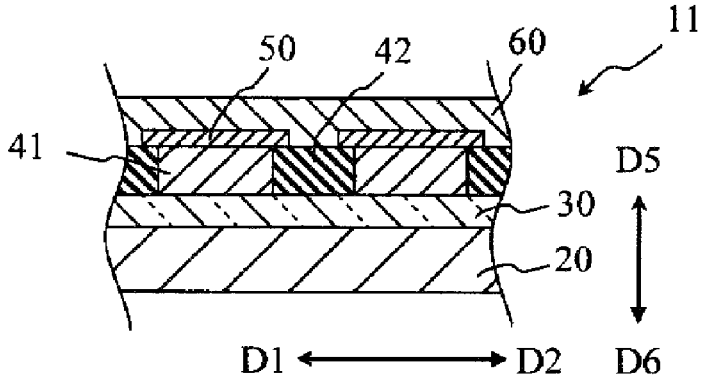

As shown in FIG. 5E, the protective layer 60 covering the conductive pattern layer 40 and the electrical resistance layer 50 is formed. Specifically, first, a mask is formed so that the site to be protected by the protective film 60 is exposed through a fine processing technique such as photolithography. Then, the protective layer 60 is formed through a film forming technique such as sputtering or vapor deposition.

The base substance 11 is now manufactured.

The driver IC 12 is arranged in a predetermined region of the base substance 11 manufactured. Specifically, the base substance 11 and the driver IC 12 are connected via a conductive member such as, for example and without limitation, a conductive bump and an anisotropic conductive material.

The external connection member 13 is arranged in a predetermined region of the base substance 11. Specifically, the base substance 11 and the external connection member 13 are connected via a conductive member such as, for example, a conductive bump and an anisotropic conductive material.

The process for manufacturing the thermal head 10 of the present embodiment may be now completed.

Figure 6:
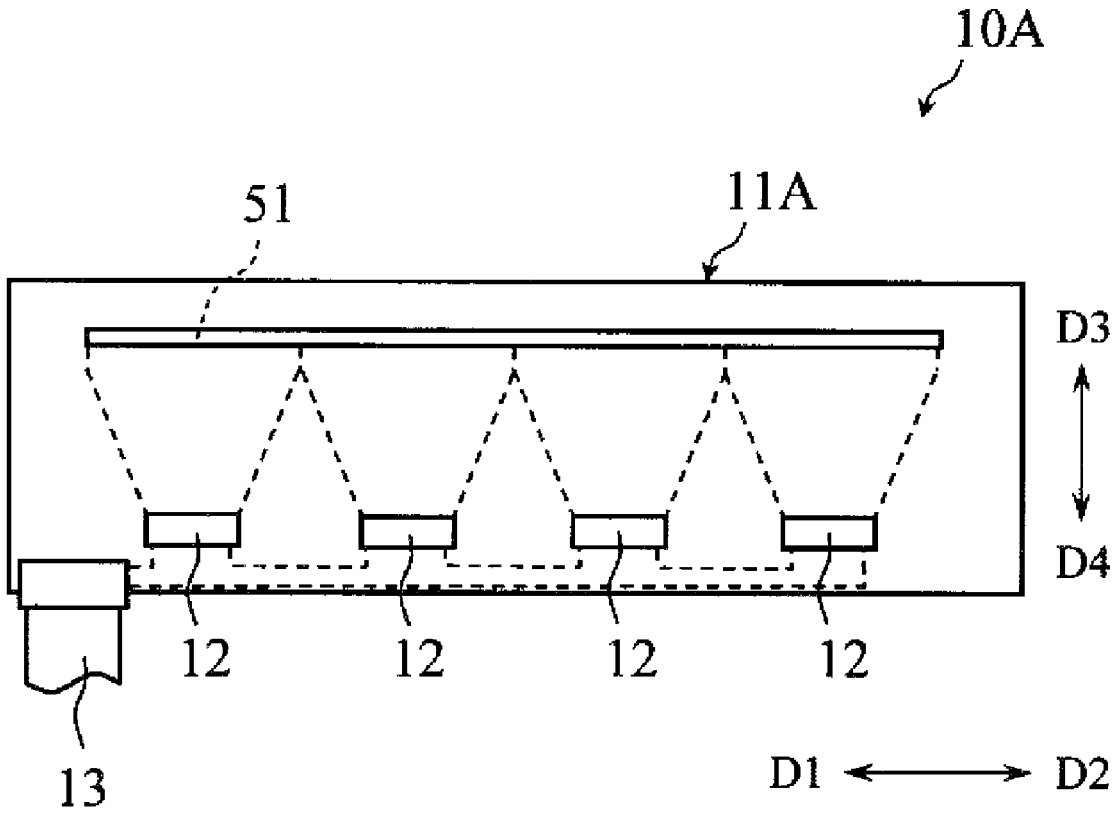
FIG. 6 is a plan view schematically illustrating a thermal head according to an embodiment of the present disclosure.
Figure 7:
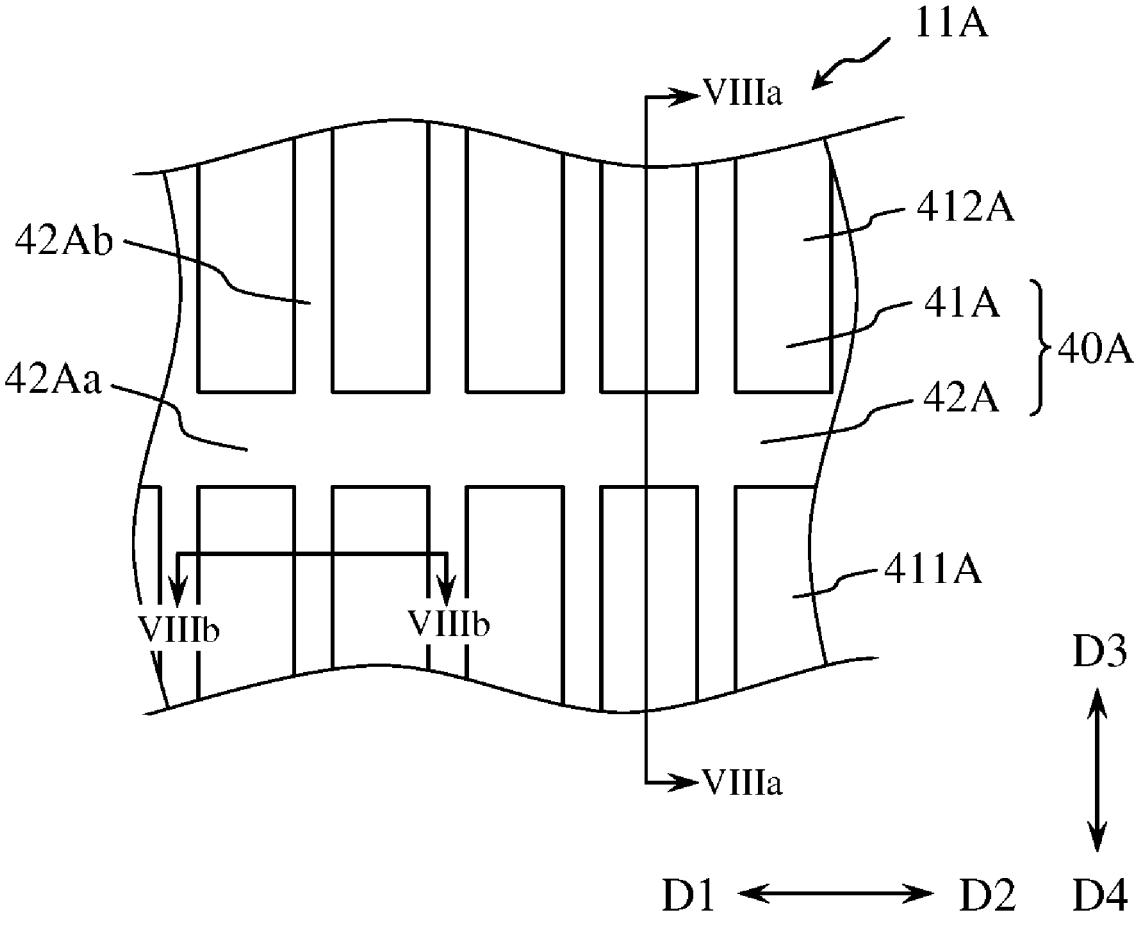
FIG. 7 is a plan view schematically illustrating the base substance shown in FIG. 6.
Figure 8A:
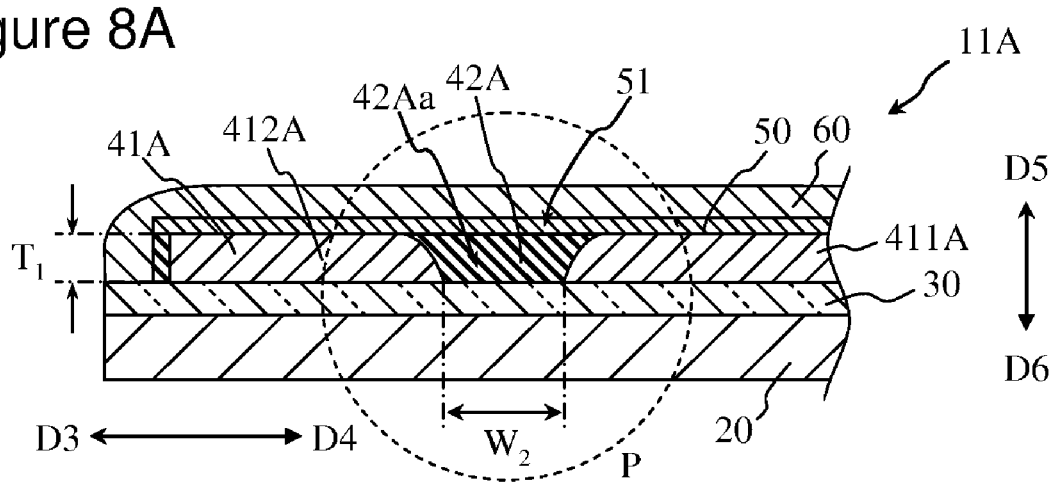
FIG. 8A is a cross-sectional view along the line VIIIa-VIIIa shown in FIG. 7.
Figure 8B:
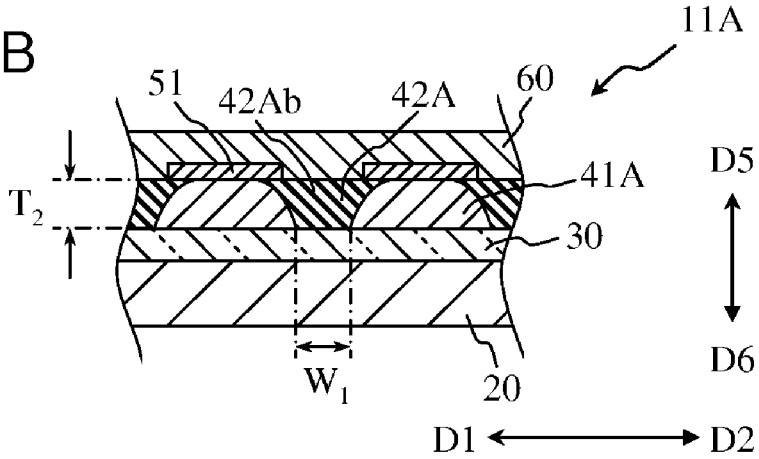
FIG. 8B is a cross-sectional view along the line VIIIb-VIIIb shown in FIG. 7.

A thermal head according to an embodiment of the present disclosure is described below in conjunction with FIGS. 6 to 8. FIG. 6 is a plan view schematically illustrating a thermal head according to an embodiment of the present disclosure. FIG. 7 is a plan view schematically illustrating the base substance shown in FIG. 6. FIG. 8A is a cross-sectional view along the line VIIIa-VIIIa shown in FIG. 7, and FIG. 8B is a cross-sectional view along the line VIIIb-VIIIb shown in FIG. 7.

A thermal head 10A is different from the thermal head 10 shown in the embodiment of FIGS. 1 to 5. That is, the thermal head 10A comprises a base substance 11A while the thermal head 10 comprises the base substance 11. Other configurations of the thermal head 10A are similar to the thermal head 10 described above.

The base substance 11A is different from the base substance 11. The base substance 11A comprises a conductive pattern layer 40A while the base substance 11 comprises the conductive pattern layer 40. Other configurations of the base substance 11A are similar to those of the base substance 11 described above.

The conductive pattern layer 40A may comprise a conductive portion 41A and an insulating portion 42A. The conductive pattern layer 40A may comprise a single layer and also comprise an approximately flat top surface on the side of the direction of arrow D5. The top surface on the side of the direction of arrow D5 may face the conductive portion 41A and the insulating portion 42A.

The conductive portion 41A may comprise a first portion 411A and a second portion 412A. In the conductive portion 41A, the upper and lower surfaces in the arrowed directions D5, D6 configure part of the upper and lower surfaces in the arrowed directions D5, D6 of the conductive pattern layer 40A. That is, the conductive portion 41A may penetrate the conductive pattern layer 40A in the arrowed directions D5, D6.

The first portion 411A may contribute to supplying power to the heat-generating portion 51. In the first portion 411A, one end of the heat-generating portion 51 is connected to one end on the side of the direction of the arrow D3, and the driver IC 12 is connected to the other end on the side of the direction of the D4. The first portion 411A is electrically connected to a reference potential point (i.e., ground) via the driver IC 12.

The second portion 412A may contribute to supplying power to the heat-generating portion 51 by making a pair with the first portion 411A. The other end of the heat-generating portion 51 and a power source (not shown) are electrically connected to one end of the second portion 412A.

In the present embodiment, a clearance $W_1$ between the first portions 411A and between the second portions 412A in the arrowed directions D1, D2 is gradually shortened from the D5 direction toward the direction of arrow D6. In addition, an interval $W_2$ between the first portion 411A and the second portion 412A paired with the first portion 411A in the direction of arrow D1 is gradually shortened from the direction of D5 toward the direction of the arrow D6.

The insulating portion 42A surrounds the first portion 411A and the second portion 412A, and contacts with the sides of the first portion 411A and the second portion 412A. In addition, in the insulating portion 42A, the upper and lower surfaces in the arrowed directions D5, D6 configure part of the upper and lower surfaces in the arrowed directions D5, D6 of the conductive pattern layer 40A. That is, the insulating portion 42A may penetrate the conductive pattern layer 40A in the arrowed directions D5, D6.

Figure 8C:
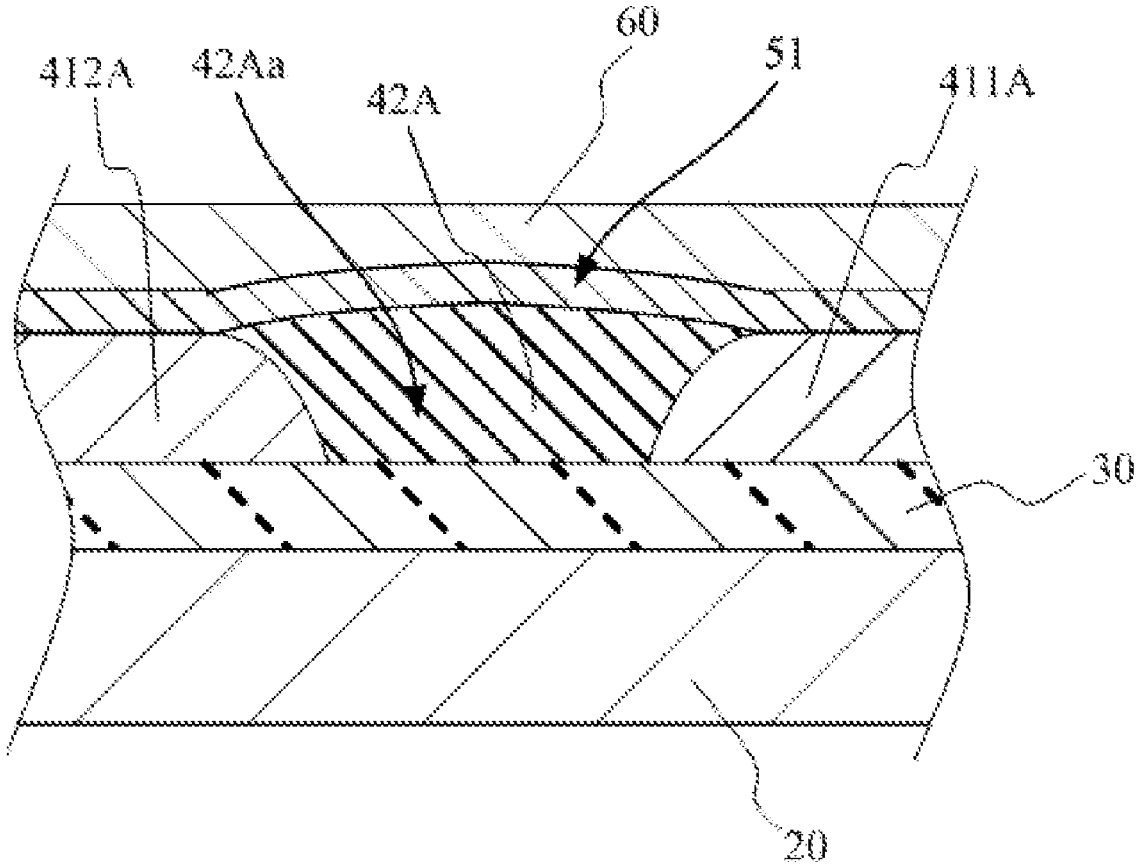
FIG. 8C is an enlarged cross-sectional view inside the circle P shown in FIG. 8A.

A thickness $T_1$ in the arrowed directions D5, D6 of a partial region 42Aa of the insulating portion 42A located between the first portion 411A and the second portion 412*a* paired with the first portion 411A is gradually thinned from the center toward both directions in the arrowed directions D3, D4. FIG. 8C is an enlarged cross-sectional view inside the circle P shown in FIG. 8A. In addition, in the insulating portion 42A, a thickness $T_2$ in the arrowed directions D5, D6 of the partial region 42Ab located between the first portions 411A and between the second portions 412A is gradually thinned in the arrowed directions D1, D2.

In the thermal head 10A where the thickness $T_1$ of the partial region 42Aa of the insulating portion 42A is gradually thinned from the center of the partial region 42Aa toward the conductive portion 41A, the step between the partial region 42Aa and the conductive portion 41A can be reduced. As a result, in the thermal head 10A, variations in the resistance value of the electrical resistance layer 50 due to the step between the partial region 42Aa and the conductive portion 41A can be reduced, as shown in FIGS. 8A and 8B. Therefore, in the thermal head 10A, thermal variations generated in the heat-generating portion 51 can be reduced, and eventually, an improved image can be obtained.

In the thermal head 10A where the conductive portion 41A has a higher thermal conductivity than the insulating portion 42A and the interval $W_2$ between the first portion 411A and the second portion 412A at a site 132*b* of the insulating portion 13 is gradually shortened from the direction of D5 toward the direction of the arrow D6, the heat storage property and the heat radiation property can be balanced and a good image can be obtained.

In the thermal head 10A where the conductive portion 41A has a higher thermal conductivity than the insulating portion 42A and the clearance $W_1$ between a plurality of first portions 411*a* is gradually shortened from the direction of D5 toward the direction of the arrow D6, for example, heat generated in the heat-generating portion 51 to a recording medium conveyed and pressed by a platen roller and transferred via the conductive portion 41A can be reduced, and the heat can be transferred efficiently to the substrate 20.

The method of manufacturing the thermal head 10A is described below in conjunction with FIGS. 9A and 9B.

Figure 9A:
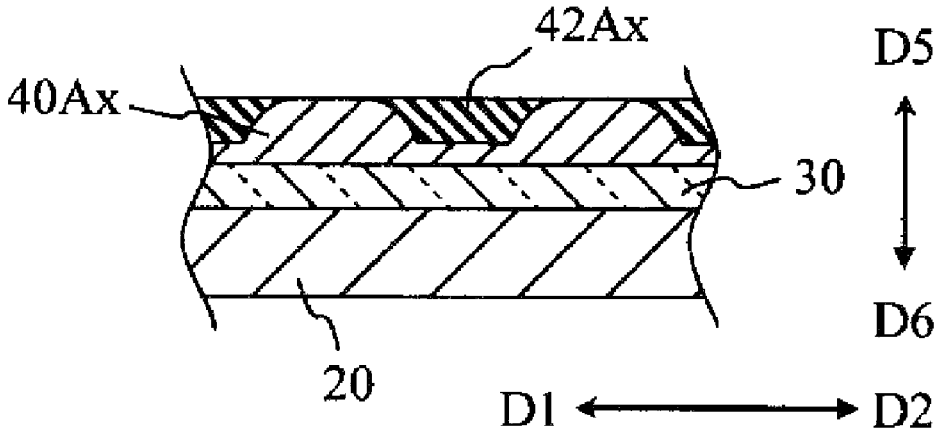
FIG. 9A is a cross-sectional view of the thermal head shown in FIG. 6 showing a part of the process of a method of manufacturing the thermal head.
Figure 9B:
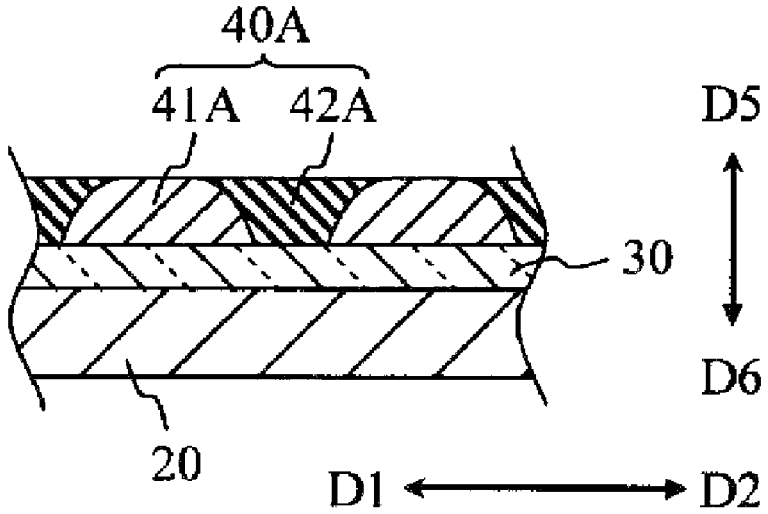
FIG. 9B is a cross-sectional view of the thermal head shown in FIG. 6 showing a part of the process of a method of manufacturing the thermal head.

FIGS. 9A and 9B are cross-sectional views of the thermal head shown in FIG. 6, each showing a part of the process of a method of manufacturing the thermal head.

The method of manufacturing the thermal head 10A is different from the method of manufacturing the thermal head 10. That is, the method of manufacturing the thermal head 10A comprises a process for forming a second conductive pattern layer while the method of manufacturing the thermal head 10 comprises the process for forming a conductive pattern layer. Other processes of the method of manufacturing the thermal head 10A are similar to processes of the method of manufacturing the thermal head 10 described above.

As shown in FIGS. 9A and 9B, the conductive pattern layer 40A is formed on the substrate 20. Specifically, first, a mask is formed on a conductive film 40Ax through a fine processing technique such as photolithography. Next, the mask is processed so that part of the conductive film 40Ax located on the region where the insulating portion 42A is formed is exposed. Next, part of the exposed conductive film 40Ax is anodized to form an oxidized layer 42Ax. Next, the mask on the conductive film 40Ax is removed. Next, a mask is formed on the conductive film 40Ax and the oxidized layer 42Ax through a fine processing technique such as photolithography. Next, part of the oxidized layer 42Ax located on the region where the insulating portion 42A is formed is exposed. Next, the conductive film 40Ax is further anodized via the exposed oxidized layer 42Ax to form the insulating portion 42A. Accordingly, the conductive pattern layer 40A, in which the conductive film 40Ax remains without being anodized functions as the conductive portion 41A, can be formed.

Employing the second conductive pattern forming process described above allows for the manufacturing of the thermal head 10A of the present embodiment.

Figure 10:
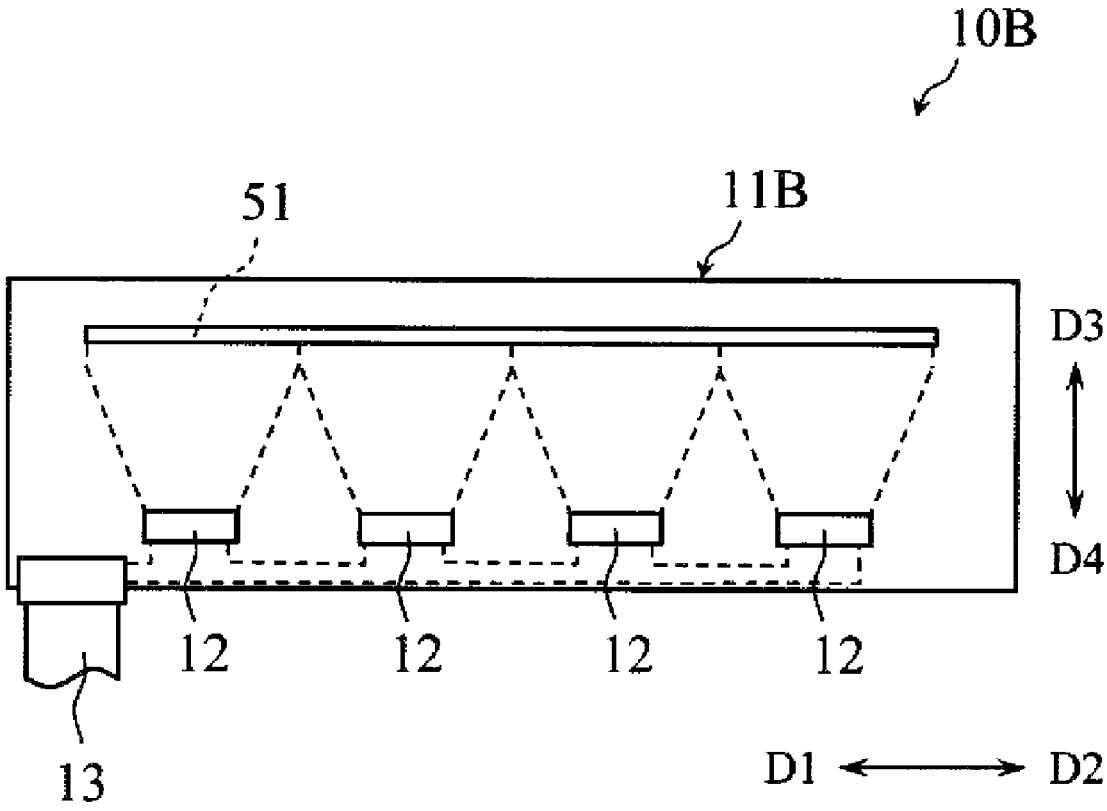
FIG. 10 is a plan view schematically illustrating a thermal head according to an embodiment of the present disclosure.
Figure 11:
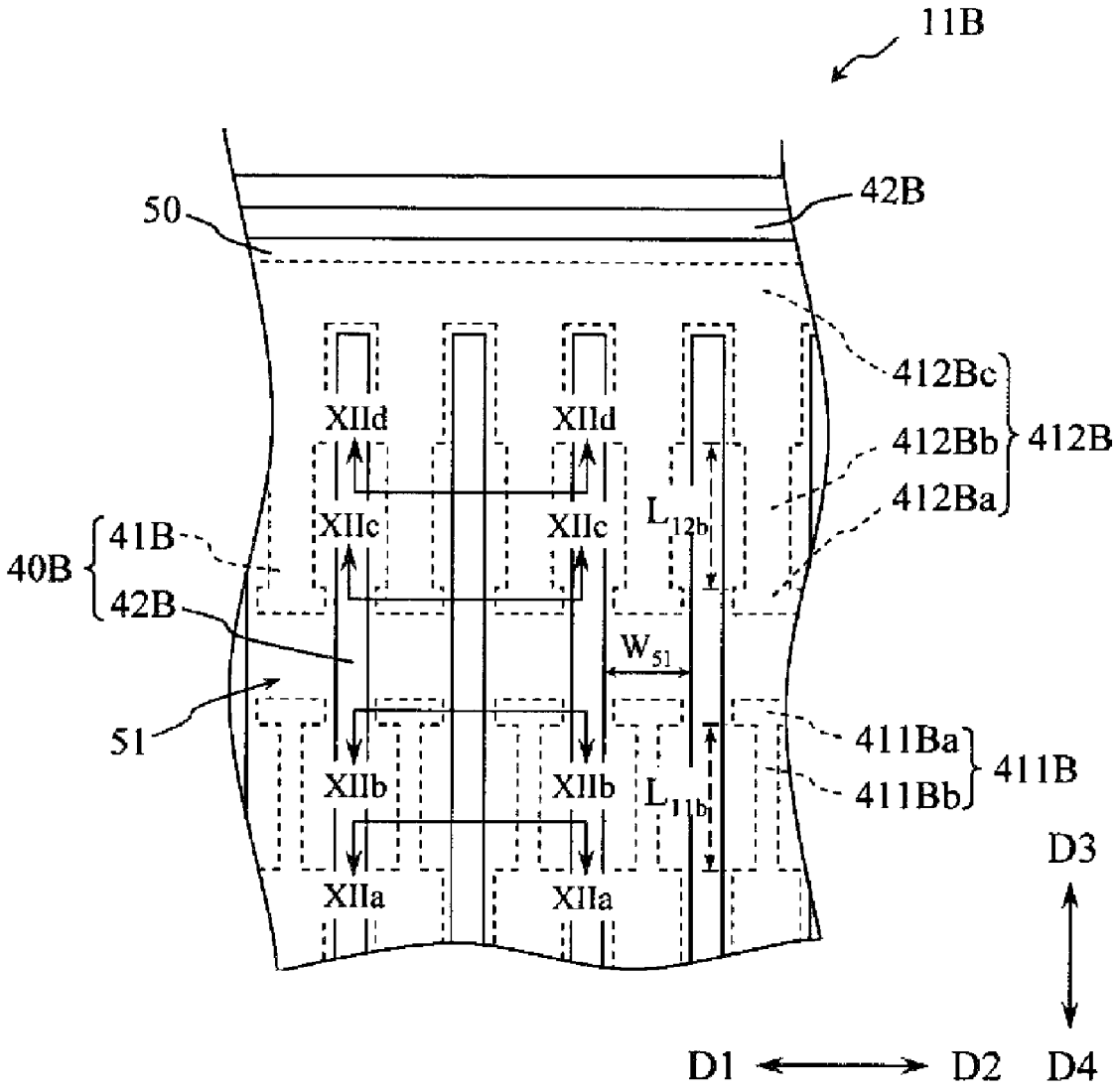
FIG. 11 is a plan view schematically illustrating the base substance shown in FIG. 10.
Figure 12A:
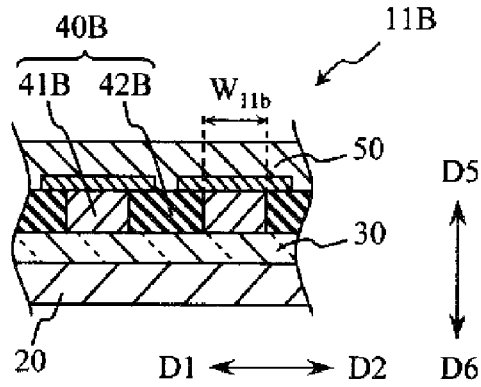
FIG. 12A is a cross-sectional view along the line XIIa-XIIa shown in FIG. 11.
Figure 12B:
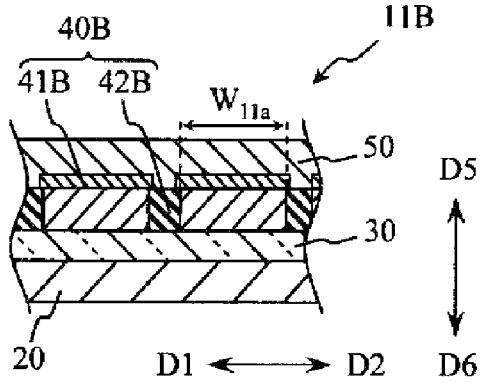
FIG. 12B is a cross-sectional view along the line XIIb-XIIb shown in FIG. 11.
Figure 12C:
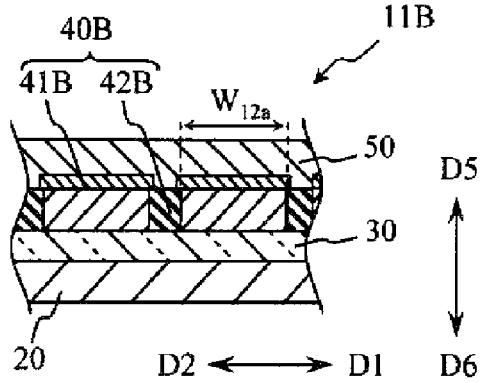
FIG. 12C is a cross-sectional view along the line XIIc-XIIc shown in FIG. 11.
Figure 12D:
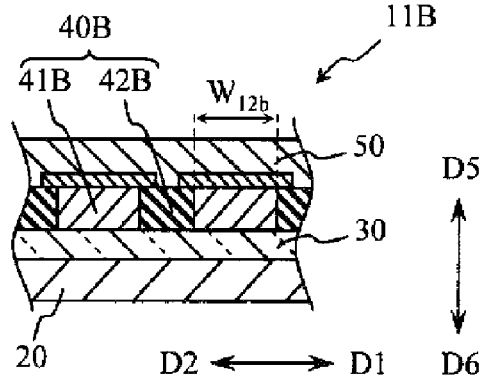
FIG. 12D is a cross-sectional view along the line XIId-XIId shown in FIG. 11.

A thermal head according to an embodiment of the present disclosure is described below in conjunction with FIGS. 10 and 11. FIG. 10 is a plan view schematically illustrating a thermal head according to an embodiment of the present disclosure. FIG. 11 is a plan view schematically illustrating the base substance shown in FIG. 10.

A thermal head 10B is different from the thermal head 10 shown in the embodiment of FIGS. 1 to 5. That is, the thermal head 10A comprises a base substance 11B while the thermal head 10 comprises the base substance 11. Other configurations of the thermal head 10B are similar to those of the thermal head 10 describe above.

The base substance 11B is different from the base substance 11. The base substance 11B comprises a conductive pattern layer 40B while the base substance 11 comprises the conductive pattern layer 40. Other configurations of the base substance 11B are similar to those of the base substance 11 described above.

The conductive pattern layer 40B may comprise a conductive portion 41B and an insulating portion 42B. The conductive pattern layer 40B may comprise a single layer and also comprise an approximately flat top surface on the side of the direction of the arrow D5. The top surface on the side of the direction of the arrow D5 may face the conductive portion 41B and the insulating portion 42B.

The conductive portion 41B may comprise a first portion 411B and a second portion 412B. In the conductive portion 41B, the upper and lower surfaces in the arrowed directions D5, D6 configure part of the upper and lower surfaces in the arrowed directions D5, D6 of the conductive pattern layer 40B. That is, the conductive portion 41B may penetrate the conductive pattern layer 40B in the arrowed directions D5, D6.

The first portion 411B may contribute to supplying power to the heat-generating portion 51. In the first portion 411B, one end of the heat-generating portion 51 is connected to one end on the side of the direction of the arrow D3, and the driver IC 12 is connected to the other end on the side of the direction of the arrow D4. The first portion 411B is electrically connected to a reference potential point (i.e., ground) via the driver IC 12.

The first portion 411B may comprise a first connection region 411Ba and a first narrow-width region 411Bb.

The first connection region 411Ba may be located on the end on the side of the direction of the arrow D3 of the first portion 411B connected to one end of the heat-generating portion 51. The first connection region 411Ba is configured so that a width $W_{11a}$ along the arrowed directions D1, D2 is generally the same as a width $W_{51}$ of the heat-generating portion 51 along the arrowed directions D1, D2 in a planar view. Here, the term "planar view" refers to the view in the direction of arrow D6. In addition, the term "generally the same" refers to a state in which the values of each site are within ±10% or less from an average value. The term "average value" refers to an arithmetic average of the maximum value and the minimum value.

The first narrow-width region 411Bb may be located on the side of the direction of the arrow D3 of the first connection region 411Ba. In addition, the first narrow-width region 411Bb comes into contact with the end on the side of the direction of the arrow D4 of the first connection region 411Ba. The first narrow-width region 411Bb is configured so that a width $W_{11b}$ along the arrowed directions D1, D2 is narrower than a width $W_{11a}$ of the first connection region 411Ba in a planar view. In addition, the first narrow-width region 411Bb is configured so that the thickness along the arrowed directions D5, D6 is generally the same as the thickness of the first connection region 411Ba along the arrowed directions D5, D6.

The second portion 412B may contribute to supplying power to the heat-generating portion 51 by making a pair with the first portion 411B. The second portion 412B may comprise a second connection region 412Ba, a second narrow-width region 412Bb, and a common connection region 412Bc.

The second connection region 412Ba is located on the end on the side of the direction of the arrow D4 of the second portion 412B connected to the other end of the heat-generating portion 51. The second connection region 412Ba is configured so that a width $W_{12a}$ along the arrowed directions D1, D2 is generally the same as a width $W_{51}$ of the heat-generating portion 51 along the arrowed directions D1, D2 in a planar view.

The second narrow-width region 412Bb is located on the side of the direction of the arrow D4 of the second connection region 412Ba. In addition, the second narrow-width region 412Bb comes into contact with the second connection region 412Ba. The second narrow-width region 412Ba is configured so that a width $W_{12b}$ along the arrowed directions D1, D2 is narrower than a width $W_{12a}$ of the first connection region 412Ba in a planar view. The width $W_{12a}$ of the second narrow-width region 412Bb may be narrower than the width $W_{11a}$ of the first narrow-width region 411Bb. In addition, the second narrow-width region 412Bb is configured so that the thickness along the arrowed directions D5, D6 is generally the same as the thickness of the second connection region 412Ba along the arrowed directions D5, D6. Furthermore, the second narrow-width region 412Bb is configured so that a length $L_{12b}$ along the arrowed directions D3, D4 is longer than a length $L_{11b}$ of the first narrow-width region 411Bb along the arrowed directions D3, D4.

In the common connection region 412Bc, a plurality of the second narrow-width regions 412Bb is electrically connected to a power source (not shown).

The insulating portion 42B surrounds the first portion 411B and the second portion 412B, and contacts with the sides of the first portion 411B and the second portion 412B. In addition, in the insulating portion 42B, the upper and lower surfaces in the arrowed directions D5, D6 configure part of the upper and lower surfaces in the arrowed directions D5, D6 of the conductive pattern layer 40B. That is, the insulating portion 42B may penetrate the conductive pattern layer 40B in the arrowed directions D5, D6.

The thermal head 10B may comprise the first connection region 411Ba, in which the first portion 411B is connected to the heat-generating portion 51, and the first narrow-width region 411Bb, in which the width $W_{11b}$ along the arrowed directions D1, D2 is narrower than the width $W_{11a}$ of the first connection region 411Ba in the of arrowed directions D1, D2. As a result, in the thermal head 10B, the heat generated in the heat-generating portion 51 is not transferred easily via the first narrow-width region 411Bb, and dissipation of the heat generated in the heat-generating portion 51 via the first narrow-width region 411Bb can thereby be reduced. Therefore, in the thermal head 10B, the heat generated in the heat-generating portion 51 can be utilized effectively.

In addition, the thermal head 10B may comprise the second connection region 412Ba, in which the second portion 412B is connected to the heat-generating portion 51, and the first narrow-width region 412Bb, in which the width $W_{12b}$ along the arrowed directions D1, D2 is narrower than the width $W_{12a}$ of the second connection region 412Ba in the arrowed directions D1, D2. As a result, in the thermal head 10B, the heat generated in the heat-generating portion 51 is not transferred easily via the second narrow-width region 412Bb, and dissipation of the heat generated in the heat-generating portion 51 via the second narrow-width region 412Bb can thereby be reduced. Therefore, in the thermal head 10B, the heat generated in the heat-generating portion 51 can be utilized effectively.

Figure 13A:
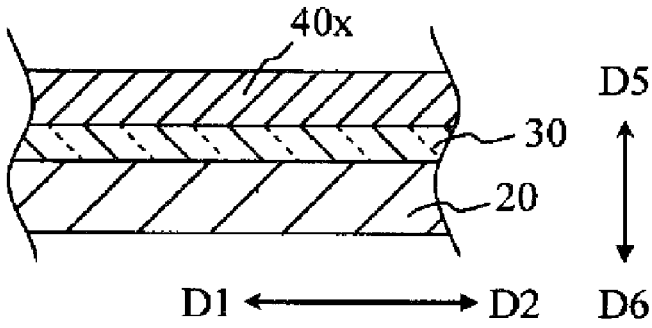
FIG. 13A is a cross-sectional view of the thermal head shown in FIG. 10 showing a part of the process of a method of manufacturing the thermal head.
Figure 13B:
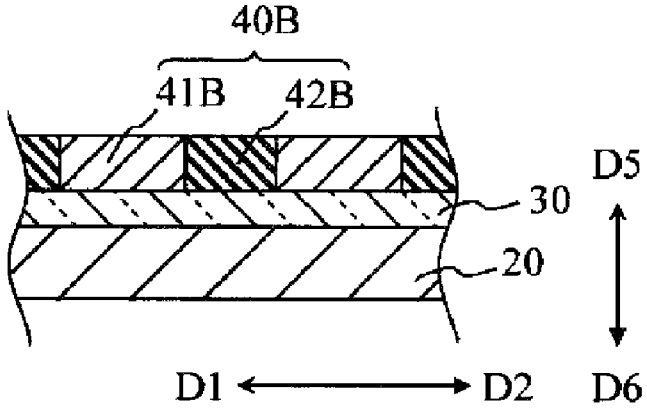
FIG. 13B is a cross-sectional view of the thermal head shown in FIG. 10 showing a part of the process of a method of manufacturing the thermal head.

The method of manufacturing the thermal head 10B is described below in conjunction with FIGS. 12A-D and 13A-B. FIGS. 12A-D are cross-sectional views along the line XIIa-XIIa, XIIb-XIIb, XIIc-XIIc, and XIId-XIId shown in FIG. 11, respectively. FIG. 13A is a cross-sectional view of the thermal head shown in FIG. 10 showing a part of the process of a method of manufacturing the thermal head. FIG. 13B is a cross-sectional view of the thermal head shown in FIG. 10 showing a part of the process of a method of manufacturing the thermal head.

The method of manufacturing the thermal head 10B is different from the method of manufacturing the thermal head 10. That is, the method of manufacturing the thermal head 10A comprises a process for forming a third conductive pattern layer while the method of manufacturing the thermal head 10 comprises the process for forming a conductive pattern layer. Other processes of the method of manufacturing the thermal head 10B are similar to processes of the method of manufacturing the thermal head 10 described above.

As shown in FIGS. 13A and 13B, the conductive pattern layer 40B is formed on the substrate 20. Specifically, first, a mask is formed on the conductive film 40Bx through a fine processing technique such as photolithography. Next, it is processed so that part of the conductive film 40Bx located on the region where the insulating portion 42B is formed is exposed. During the process, the mask is processed so that the widths in the arrowed directions D1, D2 of the regions to be the first narrow-width region 411Bb and the second narrow-width region 412Bb are narrower than the regions to be the first connection region 411Ba and the second connection region 412Ba. Then, part of the exposed conductive film 40Bx is anodized to form the insulating portion 42B. Accordingly, the conductive pattern layer 40B, in which the conductive film 40Bx remains without being anodized functions as the conductive portion 41B, can be formed.

Employing the process for forming a third conductive pattern as described above allows for the manufacturing of the thermal head 10B of the present embodiment.

Figure 14:
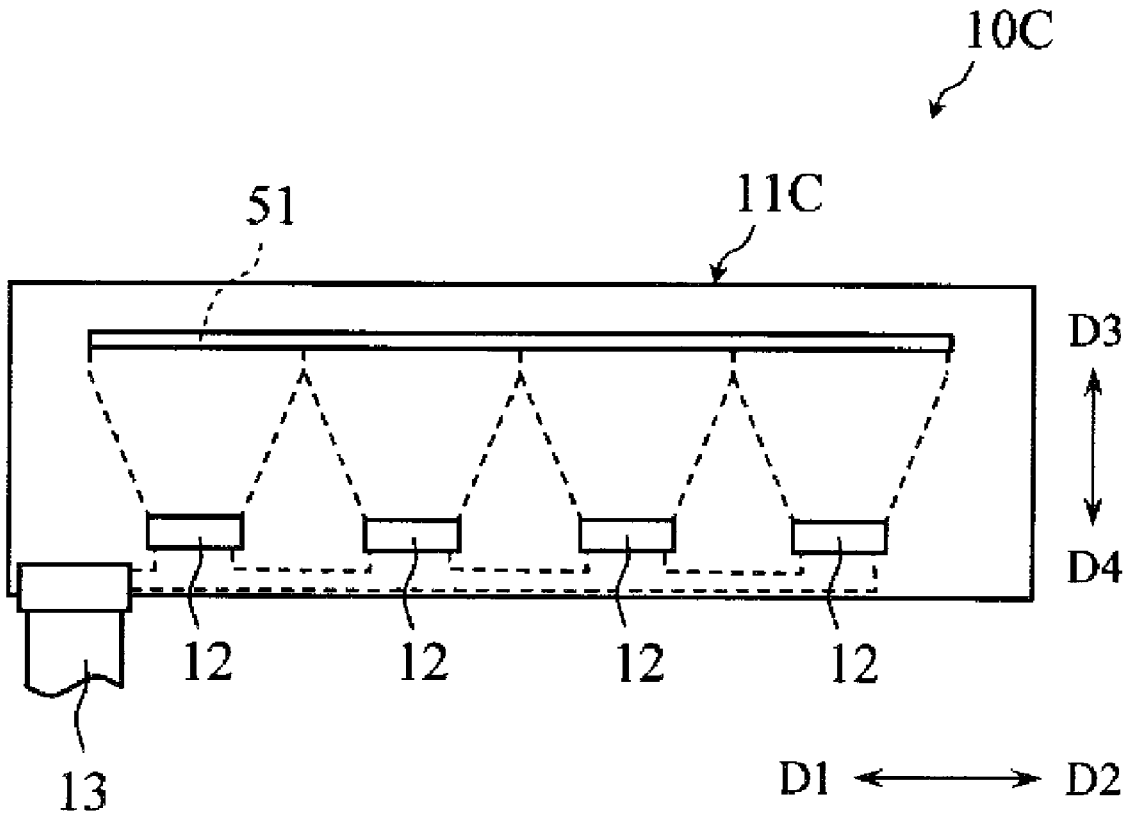
FIG. 14 is a plan view schematically illustrating a thermal head according to an embodiment of the present disclosure.
Figure 15A:
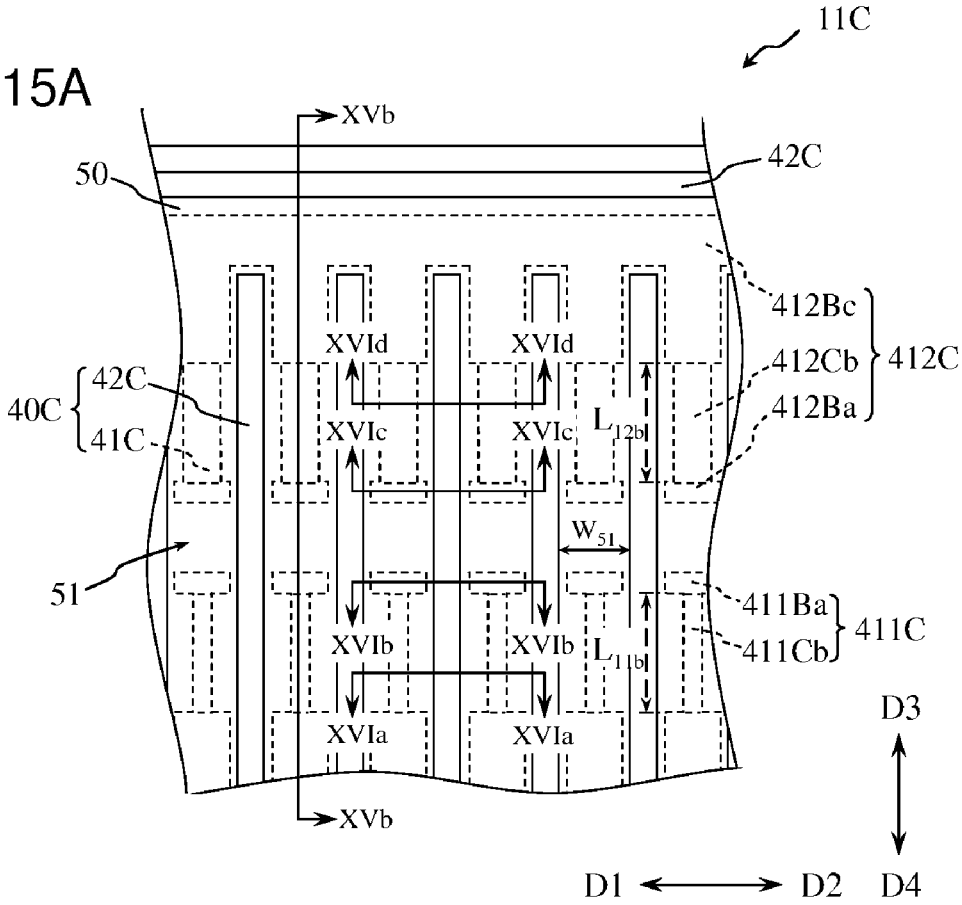
FIG. 15A is a plan view schematically illustrating the base substance shown in FIG. 14
Figure 15B:
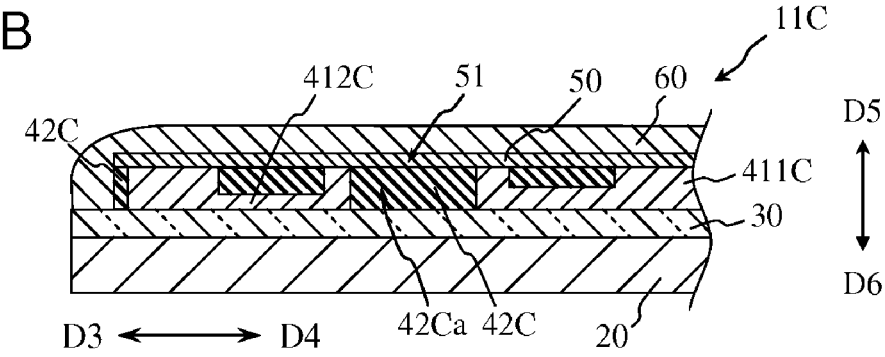
FIG. 15B is a cross-sectional view along the line XVb-XVb shown in FIG. 15A.
Figure 16A:
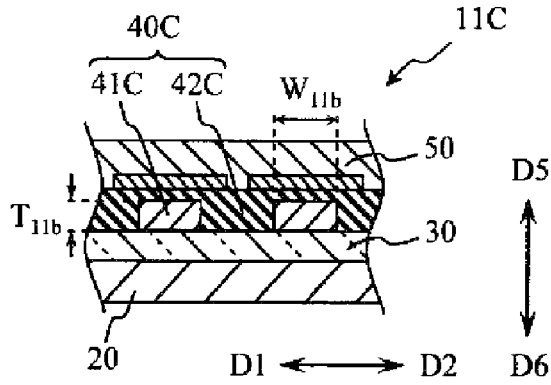
FIG. 16A is a cross-sectional view along the line XVIa-XVIa shown in FIG. 15.
Figure 16B:
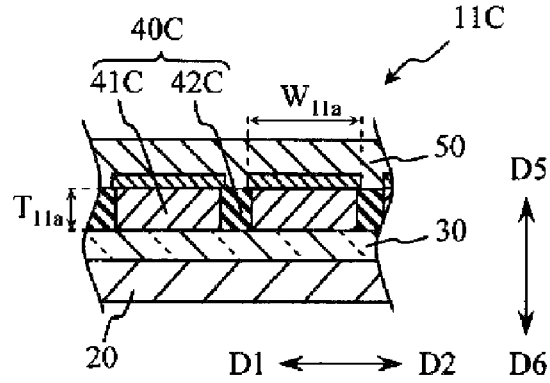
FIG. 16B is a cross-sectional view along the line XVIb-XVIb shown in FIG. 15.
Figure 16C:
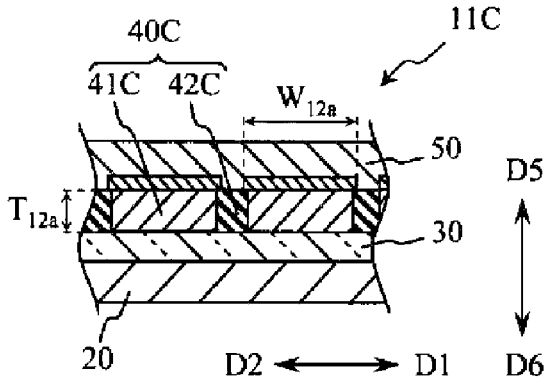
FIG. 16C is a cross-sectional view along the line XVIc-XVIc shown in FIG. 15.
Figure 16D:
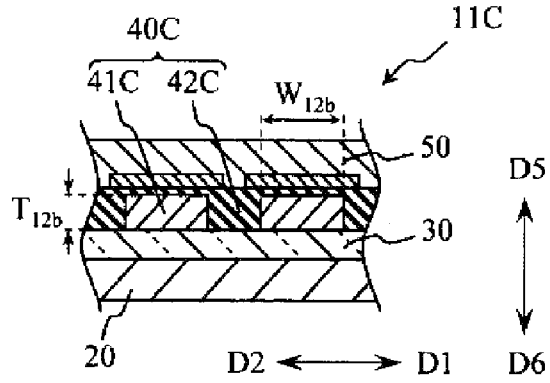
FIG. 16D is a cross-sectional view along the line XVId-XVId shown in FIG. 15.

A thermal head according to an embodiment of the present disclosure is described below in conjunction with FIGS. 14, 15 and 16. FIG. 14 is a plan view schematically illustrating a thermal head according to an embodiment of the present disclosure. FIG. 15A is a plan view schematically illustrating the base substance shown in FIG. 14, and FIG. 15B is a cross-sectional view along the line XVb-XVb shown in FIG. 15A. FIG. 16A is a cross-sectional view along the line XVIa-XVIa shown in FIG. 15. FIG. 16B is a cross-sectional view along the line XVIb-XVIb shown in FIG. 15. FIG. 16C is a cross-sectional view along the line XVIc-XVIc shown in FIG. 15. FIG. 16D is a cross-sectional view along the line XVId-XVId shown in FIG. 15.

A thermal head 10C is different from the thermal head 10B shown in the embodiment of FIGS. 10-13. That is, the thermal head 10C comprises a base substance 11C while the thermal head 10B comprises the base substance 11B. Other configurations of the thermal head 10C are similar to those of the thermal head 10B.

The base substance 11C is different from the base substance 11B. The base substance 11C comprises a conductive pattern layer 40C while the base substance 11B comprises the conductive pattern layer 40B. Other configurations of the base substance 11C are similar to those of the base substance 11B described above.

The conductive pattern layer 40C may comprise a conductive portion 41C and an insulating portion 42C. The conductive pattern layer 40C may comprise a single layer and also comprise an approximately flat top surface on the side of the direction of the arrow D5. The top surface on the side of the direction of the arrow D5 may face the conductive portion 41C and the insulating portion 42C.

The conductive portion 41C may comprise a first portion 411C and a second portion 412C.

The first portion 411C is different from the first portion 411B. The first portion 411C comprises a first narrow-width region 411Cb while the first portion 411B comprises the first narrow-width region 411Bb. Other configurations of the first portion 411C are similar to those of the first portion 411B described above.

The first narrow-width region 411Cb is located on the side of the direction of the arrow D3 of the first connection region 411Ba. In addition, the first narrow-width region 411Cb comes into contact with the first connection region 411Ba. The first narrow-width region 411Cb is configured so that a width $W_{11b}$ along the arrowed directions D1, D2 is narrower than a width $W_{11a}$ of the first connection region 411Ca in a planar view. In addition, the first narrow-width region 411Cb is configured so that a thickness $T_{11a}$ along the arrowed directions D5, D6 is narrower than a thickness $T_{11b}$ of the first connection region 411Ba along the arrowed directions D5, D6.

The second portion 412C is different from the second portion 412B. The second portion 412C comprises the second narrow-width region 412Cb while the second portion 412B comprises the second narrow-width region 412Bb. Other configurations of the second portion 412C are similar to those of the second portion 412B described above.

The second narrow-width region 412Cb is located on the side of the direction of the arrow D4 of the second connection region 412Ba. In addition, the second narrow-width region 412Cb comes into contact with the second connection region 412Ba. The second narrow-width region 412Cb is configured so that a width $W_{12b}$ along the arrowed directions D1, D2 is narrower than a width $W_{12a}$ of the second connection region 412Ca in a planar view. The width $W_{12a}$ of the second narrow-width region 412Cb is configured to be narrower than the width $W_{11a}$ of the first narrow-width region 411Cb. In addition, the second narrow-width region 412Cb is configured so that a thickness $T_{12b}$ along the arrowed directions D5, D6 is narrower than a thickness $T_{12a}$ of the second connection region 412Ba along the arrowed directions D5, D6.

That is, the insulating portion 42C surrounds the first portion 411C and the second portion 412C and is formed in a state in which it comes into contact with the sides of the first portion 411C and the second portion 412C. The insulating portion 42C may cover the top surfaces of the first narrow-width region 411Cb and the second narrow-width region 412Cb. In addition, in part of the insulating portion 42C, the upper and lower surfaces in the arrowed directions D5, D6 configure part of the upper and lower surfaces in the arrowed directions D5, D6 of the conductive pattern layer 40C. That is, the insulating portion 42C is configured to penetrate the conductive pattern layer 40C in the arrowed directions D5, D6.

The thermal head 10C may comprise the first connection region 411Ba, in which the first portion 411B is connected to the heat-generating portion 51, and the first narrow-width region 411Bb, in which the thickness $T_{11b}$ along the arrowed directions D5, D6 is narrower than the thickness $T_{11a}$ of the first connection region 411Ba in the arrowed directions D5, D6. As a result, in the thermal head 10C, the heat generated in the heat-generating portion 51 is not transferred easily via the first narrow-width region 411Cb, and dissipation of the heat generated in the heat-generating portion 51 via the first narrow-width region 411Cb can thereby be reduced. Therefore, in the thermal head 10C, the heat generated in the heat-generating portion 51 can be utilized effectively.

In addition, the thermal head 10C may comprise the second connection region 412Ba, in which the second portion 412B is connected to the heat-generating portion 51, and the second narrow-width region 412Bb, in which the thickness $T_{12b}$ along the arrowed directions D5, D6 is narrower than the thickness $T_{12a}$ of the first connection region 412Ba in the arrowed directions D1, D2. As a result, in the thermal head 10C, the heat generated in the heat-generating portion 51 is not transferred easily via the second narrow-width region 412Cb, and dissipation of the heat generated in the heat-generating portion 51 via the second narrow-width region 412Cb can thereby be reduced. Therefore, in the thermal head 10C, the heat generated in the heat-generating portion 51 can be utilized effectively.

In the thermal head 10C, the insulating portion 42C may cover the top surface of the first narrow-width region 411Cb. As a result, in the thermal head 10C, the first narrow-width region 411Cb having a narrower thickness than the first connection region 411Ba can be protected well by the insulating portion 42C even when a pressing force is applied on the periphery of the heat-generating portion 51 by a platen roller, for example.

In addition, in the thermal head 10C where the insulating portion 42C covers the top surface of the first narrow-width region 411Cb, transmission of heat from the first portion 411C in the direction of the arrow D5 can be reduced.

Furthermore, in the thermal head 10C where the insulating portion 42C covers the top surface of the first narrow-width region 411Cb, the electric reliability of the first narrow-width region 411Cb can be increased.

In the thermal head 10C where the insulating portion 42C covers the top surface of the second narrow-width region 412Cb, the second narrow-width region 412Cb having a narrower thickness than the first connection region 411Ba can be protected well by the insulating portion 42C even if a pressing force is applied on the periphery of the heat-generating portion 51 by a platen roller, for example.

In addition, in the thermal head 10C where the insulating portion 42C covers the top surface of the second narrow-width region 412Cb, transmission of heat from the second portion 412C in the direction of the arrow D5 can be reduced.

Furthermore, in the thermal head 10C where the insulating portion 42C covers the top surface of the second narrow-width region 412Cb, the electric reliability of the second narrow-width region 412Cb can be increased.

Figure 17A:
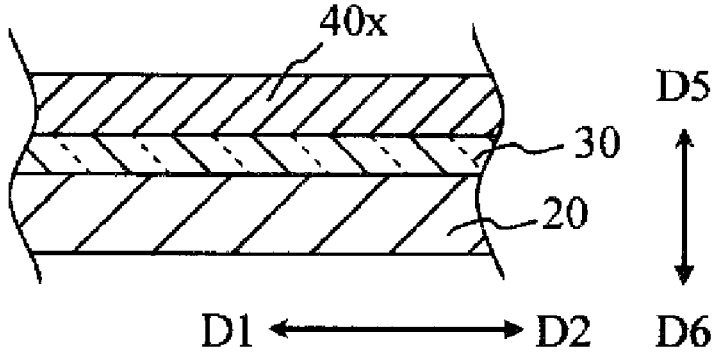
FIG. 17A is a cross-sectional view of the thermal head shown in FIG. 14 showing a part of the process of a method of manufacturing the thermal head.
Figure 17B:
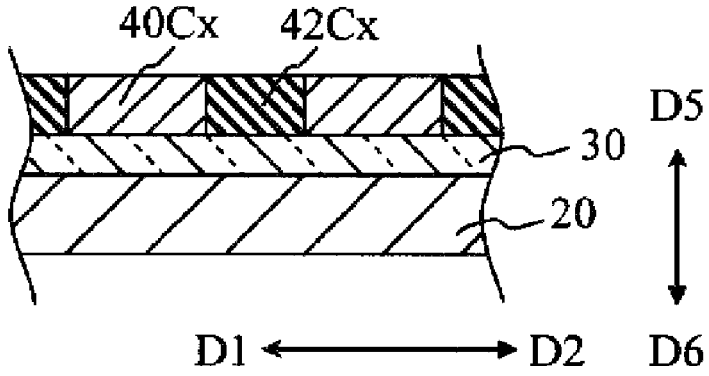
FIG. 17B is a cross-sectional view of the thermal head shown in FIG. 14 showing a part of the process of a method of manufacturing the thermal head.
Figure 17C:
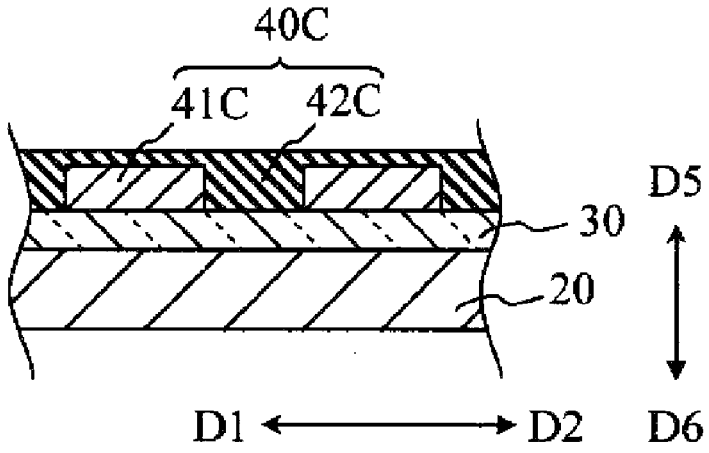
FIG. 17C is a cross-sectional view of the thermal head shown in FIG. 14 showing a part of the process of a method of manufacturing the thermal head.

The method of manufacturing the thermal head 10C is described below in conjunction with FIGS. 17A-C. FIGS. 17A-C are cross-sectional views of the thermal head shown in FIG. 14, each showing a part of the process of a method of manufacturing the thermal head.

The method of manufacturing the thermal head 10C is different from the method of manufacturing the thermal head 10. That is, the method of manufacturing the thermal head 10C comprises a process for forming a fourth conductive pattern layer while the method of manufacturing the thermal head 10 comprises the process for forming a conductive pattern layer. Other processes of the method of manufacturing the thermal head 10C are similar to those of the thermal head 10 described above.

As shown in FIGS. 17A and B, the conductive pattern layer 40C is formed on the substrate 20. Specifically, first, a mask is formed on the conductive film 40Cx through a fine processing technique such as photolithography. Next, the mask is processed so that part of the conductive film 40Cx located on the region where the insulating portion 42C is formed is exposed. During the process, the mask is processed so that the widths in the arrowed directions D1, D2 of the regions to be the first narrow-width region 411Cb and the second narrow-width region 412Cb are narrower than the regions to be the first connection region 411Ba and the second connection region 412Ba. Next, part of the exposed conductive film 40Cx is anodized to form an oxidized layer 42Cx. Next, the mask on the conductive film 40Cx is removed. Next, a mask is formed on the conductive film 40Cx and the oxidized layer 42Cx through a fine processing technique such as photolithography. Next, part of the oxidized layer 42Cx located on the region where the insulating portion 42C is formed is exposed. During the process, the regions to be the first narrow-width region 411Cb and the second narrow-width region 412*cb* are exposed. Next, the conductive film 40Cx is further anodized via the exposed oxidized layer 42Cx to form the insulating portion 42C. Accordingly, the conductive pattern layer 40C, in which the conductive film 40Cx remaining without being anodized functions as the conductive portion 41C, can be formed.

Employing the process for forming a fourth conductive pattern as described above allows for the manufacturing of the thermal head 10C of the present embodiment.

Figure 18:
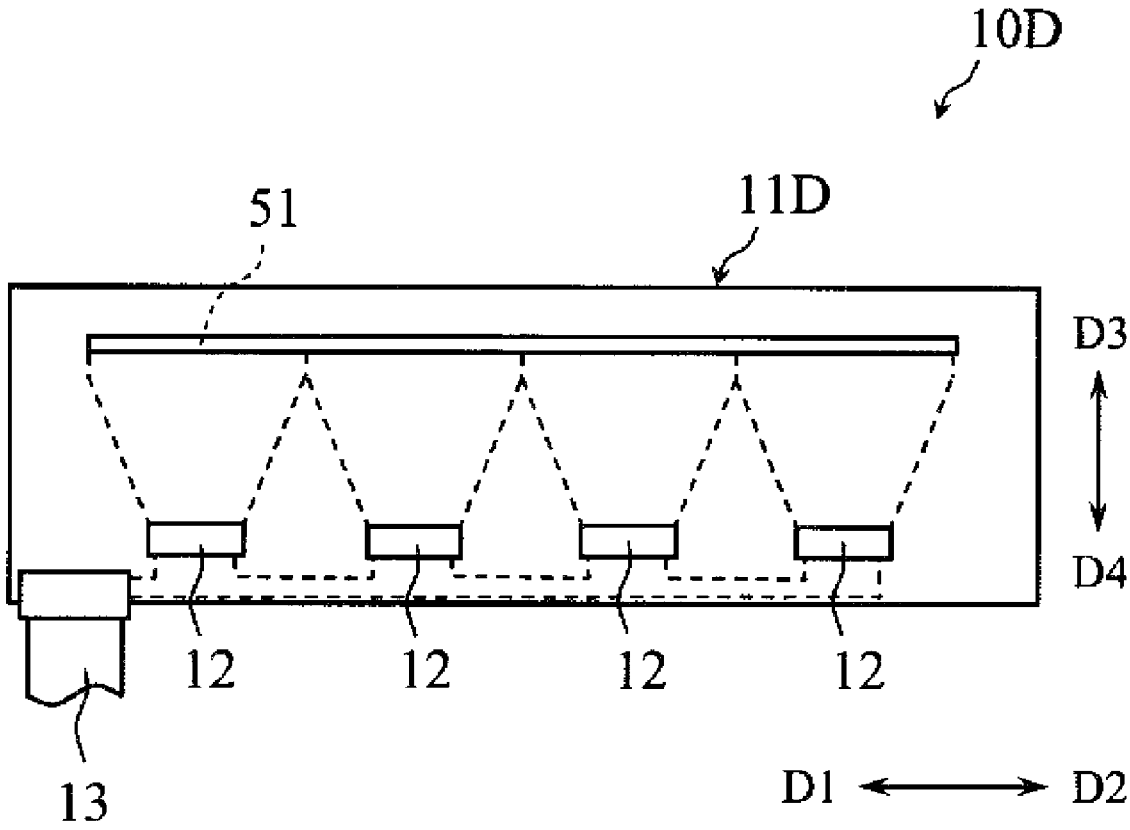
FIG. 18 is a plan view schematically illustrating a thermal head according to an embodiment of the present disclosure.
Figure 19A:
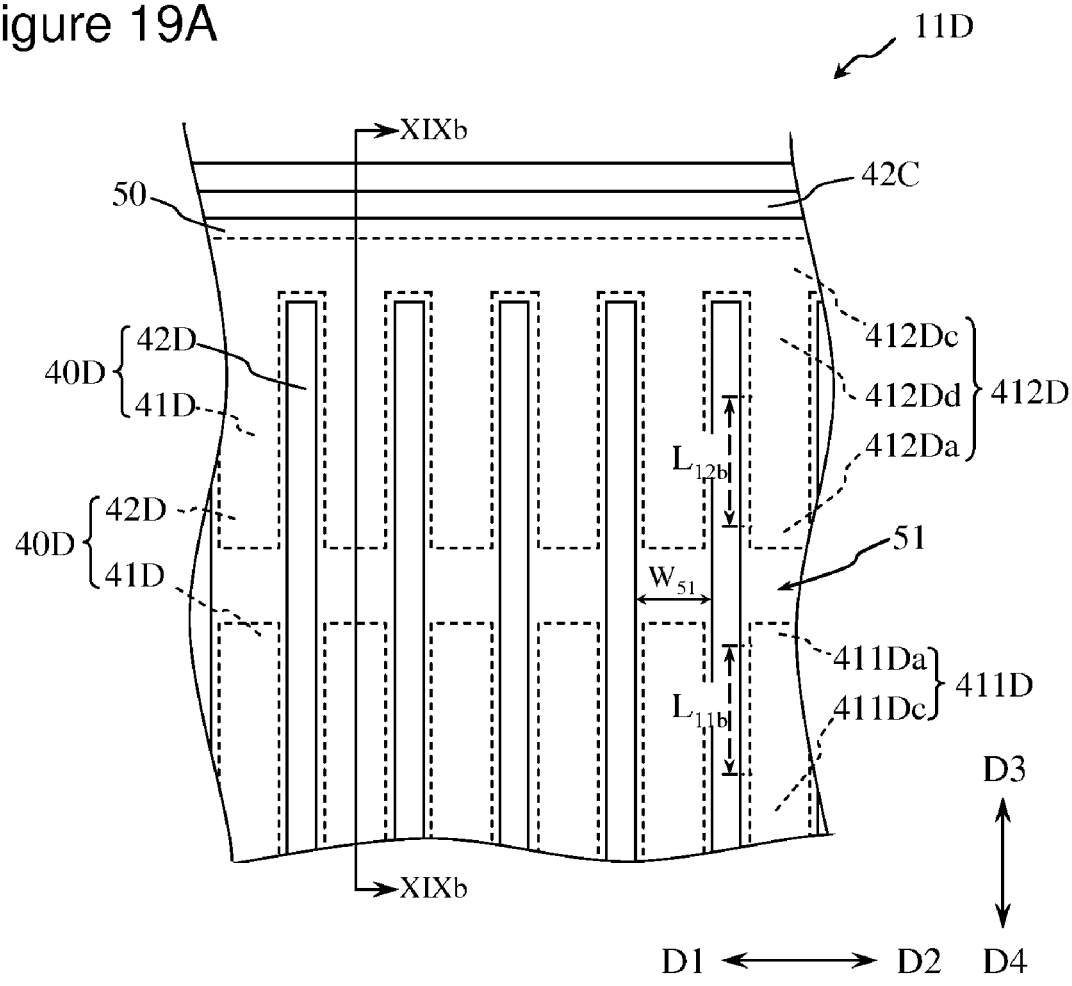
FIG. 19A is a plan view schematically illustrating the base substance shown in FIG. 18.
Figure 19B:
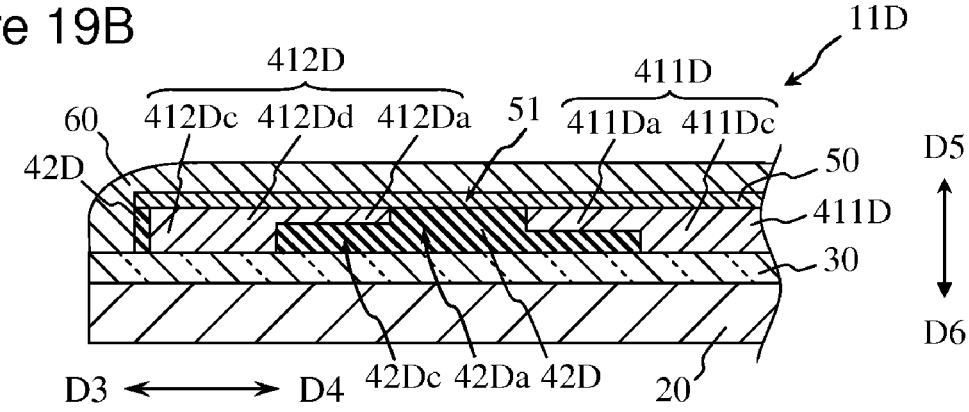
FIG. 19B is a cross-sectional view along the line XIXb-XIXb shown in FIG. 19A.

A thermal head according to an embodiment of the present disclosure is described below in conjunction with FIGS. 18 and 19. FIG. 18 is a plan view schematically illustrating a thermal head according to an embodiment of the present disclosure. FIG. 19A is a plan view schematically illustrating the base substance shown in FIG. 18. a cross-sectional view along the line XIXb-XIXb shown in FIG. 19A.

A thermal head 10D is different from the thermal head 10 in the embodiment shown in FIGS. 1-5. That is, the thermal head 10D comprises a base substance 11D while the thermal head 10 comprises the base substance 11. Other configurations of the thermal head 10D are similar to those of the thermal head 10 described above.

The base substance 11D is different from the base substance 11. That is, the base substance 11D comprises a conductive pattern layer 40D while the base substance 11 comprises the conductive pattern layer 40. Other configurations of the base substance 11D are similar to those of the base substance 11 described above.

The conductive pattern layer 40D may comprise a conductive portion 41D and an insulating portion 42D. The conductive pattern layer 40D may comprise a single layer and has an approximately flat top surface on the side of the direction of arrow D5. The top surface on the side of the direction of arrow D5 may face the conductive portion 41D and the insulating portion 42D.

The conductive portion 41D may comprise a first portion 411D and a second portion 412D.

The first portion 411D may contribute to supplying power to the heat-generating portion 51. In the first portion 411D, one end of the heat-generating portion 51 is connected to one end on the side of the direction of the arrow D4, and the driver IC 12 is connected to the other end on the side of the direction of the arrow D3. The first portion 411D is electrically connected to a reference potential point (i.e., ground) via the driver IC 12.

The first portion 411D of the present embodiment comprises a first connection region 411Da and a first wiring region 411Db.

The first connection region 411Da is located on the end on the side of the direction of the arrow D3 of the first portion 411C connected to one end of the heat-generating portion 51. The first connection region 411Da is formed in a state in which the lower surface on the side of the direction of the arrow D6 comes into contact with the insulating portion 42D.

The first wiring region 411Dc is located on the side of the direction of the arrow D3 of the first connection region 411Ba and comes into contact on the side of the direction of the arrow D4 of the first connection region 411Ba. In the first wiring region 411Dc, the upper and lower surfaces in the arrowed directions D5, D6 configure the upper and lower surfaces of the conductive pattern layer 40D. That is, the first wiring region 411Dc may penetrate the conductive pattern layer 40D in the arrowed directions D5, D6. In addition, the first wiring region 411Dc is configured so that a thickness $T_{11c}$ along the directions D5, D6 is thicker than a thickness $T_{11a}$ along the arrowed directions D5, D6 of the first connection region 411Ca.

The second portion 412D may contribute to supplying power to the heat-generating portion 51 by making a pair with the first portion 411D.

The second portion 412D may comprise a second connection region 412Da, a second wiring region 412Dd, and a common connection region 412Dc.

The second connection region 412Da is located on the end on the side of the direction of the arrow D4 of the second portion 412D connected to the other end of the heat-generating portion 51. The second connection region 412Da is formed in a state in which the lower surface on the side of the direction of the arrow D6 comes into contact with the insulating portion 42D. In addition, the second connection region 412Da is configured so that the thickness $T_{12a}$ in the arrowed directions D5, D6 is thicker than the thickness $T_{11a}$ of the first connection region 411Da.

The second wiring region 412Dd is located on the side of the direction of the arrow D4 of the second connection region 412Ba and comes into contact on the side of the direction of the arrow D4 of the second connection region 412Ba. In the second wiring region 412Dd, the upper and lower surfaces in the arrowed directions D5, D6 configure the upper and lower surfaces of the conductive pattern layer 40D. That is, the second wiring region 412Dd may penetrate the conductive pattern layer 40D in the arrowed directions D5, D6. In addition, the second wiring region 412Dd is configured so that a thickness $T_{12d}$ along the directions D5, D6 is thicker than a thickness $T_{12a}$ along the arrowed directions D5, D6 of the second connection region 412Ca. The thickness $T_{12d}$ of the second wiring region 412Dd is configured to have a roughly equivalent thickness as the thickness $T_{11c}$ of the first wiring region 411Dc.

A plurality of the second wiring regions 412Dd and a power source (not shown) are electrically connected to the second portion 412Dc.

The insulating portion 42D surrounds the first portion 411D and the second portion 412D and contacts with the sides of the first portion 411D and the second portion 412D. In addition, in the insulating portion 42D, the upper and lower surfaces in the arrowed directions D5, D6 configure part of the upper and lower surfaces in the arrowed directions D5, D6 of the conductive pattern layer 40D. That is, the insulating portion 42D is configured to penetrate the conductive pattern layer 40D in the arrowed directions D5, D6.

A part 42Db of the insulation portion 42D of the present embodiment may face the lower surface on the side of the direction of the arrow D6 of the first connection region 411Da and the second connection region 412Da.

The thermal head 10D may comprise the first connection region 411Da, in which the first portion 411D is connected to the heat-generating portion 51, and the first wiring region 411Dc connected to the first connection region 411Da, and the thickness $T_{11a}$ of the first connection region 411Da is thinner than the thickness $T_{11c}$ of the first wiring region 411Dc. As a result, in the thermal head 10D, the heat generated in the heat-generating portion 51 is not transferred easily via the first connection region 411Da, and dissipation of the heat generated in the heat-generating portion 51 via the first narrow-width region 411Da can thereby be reduced.

The thermal head 10D may comprise the second connection region 412Da, in which the second portion 412D is connected to the heat-generating portion 51, and the second wiring region 412Dd connected to the second connection region 412Da, and the thickness $T_{12a}$ of the second connection region 412Da is thinner than the thickness $T_{12d}$ of the second wiring region 412Dd. As a result, in the thermal head 10D, the heat generated in the heat-generating portion 51 is not transferred easily via the second connection region 412Da, and dissipation of the heat generated in the heat-generating portion 51 via the second connection region 412Da can thereby be reduced.

In the thermal head 10D where the insulating portion 42D contacts with the lower surface of the first connection region 411Da, transmission of the heat from the first portion 411D to the side of the direction of the arrow D6 can be reduced.

In the thermal head 10D where the insulating portion 42D contacts with the lower surface of the second connection region 412Da, transmission of the heat from the second portion 412D to the side of the direction of the arrow D6 can be reduced.

Figure 20A:
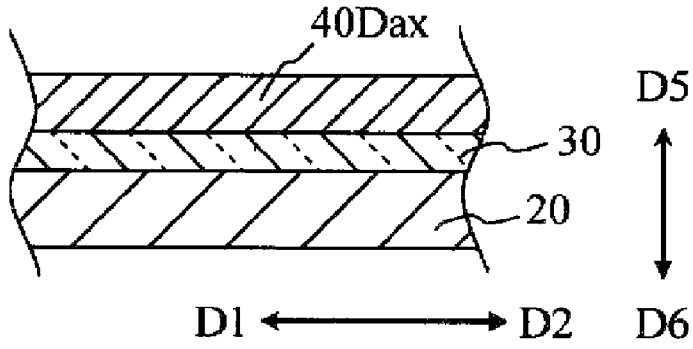
FIG. 20A is a cross-sectional view of the thermal head shown in FIG. 18 showing a part of the process of a method of manufacturing the thermal head.
Figure 20B:
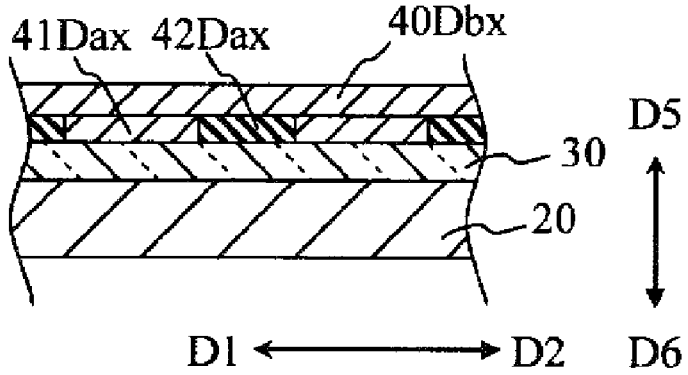
FIG. 20B is a cross-sectional view of the thermal head shown in FIG. 18 showing a part of the processes of a method of manufacturing the thermal head.
Figure 20C:
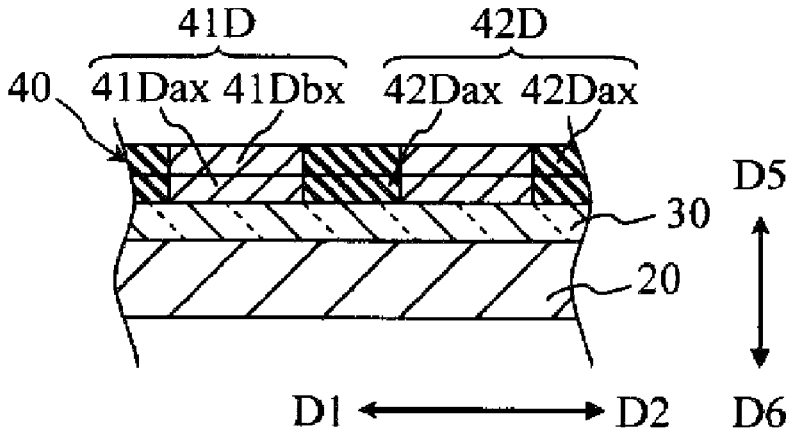
FIG. 20C is a cross-sectional view of the thermal head shown in FIG. 18 showing a part of the processes of a method of manufacturing the thermal head.

The method of manufacturing the thermal head 10D is described below in conjunction with FIGS. 20A-C. FIGS. 20A-C are cross-sectional views of the thermal head shown in FIG. 18, each showing a part of the process of a method of manufacturing the thermal head.

The method of manufacturing the thermal head 10D is different from the method of manufacturing the thermal head 10. That is, the method of manufacturing the thermal head 10D comprises a conductive film and a process for forming a fifth conductive pattern layer while the method of manufacturing the thermal head 10 comprises the process for forming a conductive film and the process for forming a conductive pattern layer. Other processes of the method of manufacturing the thermal head 10D are similar to those of the thermal head 10 described above.

As shown in FIGS. 20A-C, the conductive pattern layer 40D is formed on the substrate 20. Specifically, first, the first conductive film 40Dax is formed by forming an aluminum film with a generally flat shape on the substrate 20 through a film forming technique such as sputtering or vapor deposition. Next, a mask is formed on the first conductive film 40Dax through a fine processing technique such as photolithography. Next, the mask is processed so that part of the first conductive film 40Dax located on the region where the insulating portion 42D is formed is exposed. During the process, the region where the part 42Db of the insulating portion 42D, which will be located on the side of the direction of the arrow D6 of the region forming the first connection region 411Da and the second connection region 412Da, is formed is processed to be exposed from the mask. Next, part of the exposed first conductive film 40Dax is anodized to form an oxidized layer 42Dax. Next, the mask on the first conductive film 40Dax is removed. Accordingly, the layer, in which the first conductive film 40Dax remains without being anodized functions as the part 41Dax of the conductive portion 41D, can be formed. Next, a second conductive film 40Dbx is formed by forming an aluminum film with a generally flat shape on the first conductive film 40Dax through a film forming technique such as sputtering or vapor deposition. Next, a mask is formed on the second conductive film 40Dbx through a fine processing technique such as photolithography. Next, the mask is processed so that part of the conductive film 40Dbx located on the region where the insulating portion 42D is formed is exposed. Next, part of the exposed second conductive film 40Dbx is anodized to form an oxidized layer 42Dax. Next, the mask on the second conductive film 40Dbx is removed. Accordingly, the layer, in which the second conductive film 40Dbx remaining without being anodized functions as the part 41Dbx of the conductive portion 41D, can be formed. Therefore, the conductive pattern layer 40D, in which the first conductive film 40Dax and the second conductive film 40Dbx remaining without being anodized function as the conductive portion 41D, can be formed.

Employing the process for forming a fifth conductive pattern as described above allows for the manufacturing of the thermal head 10D of the present embodiment.

Figure 21:
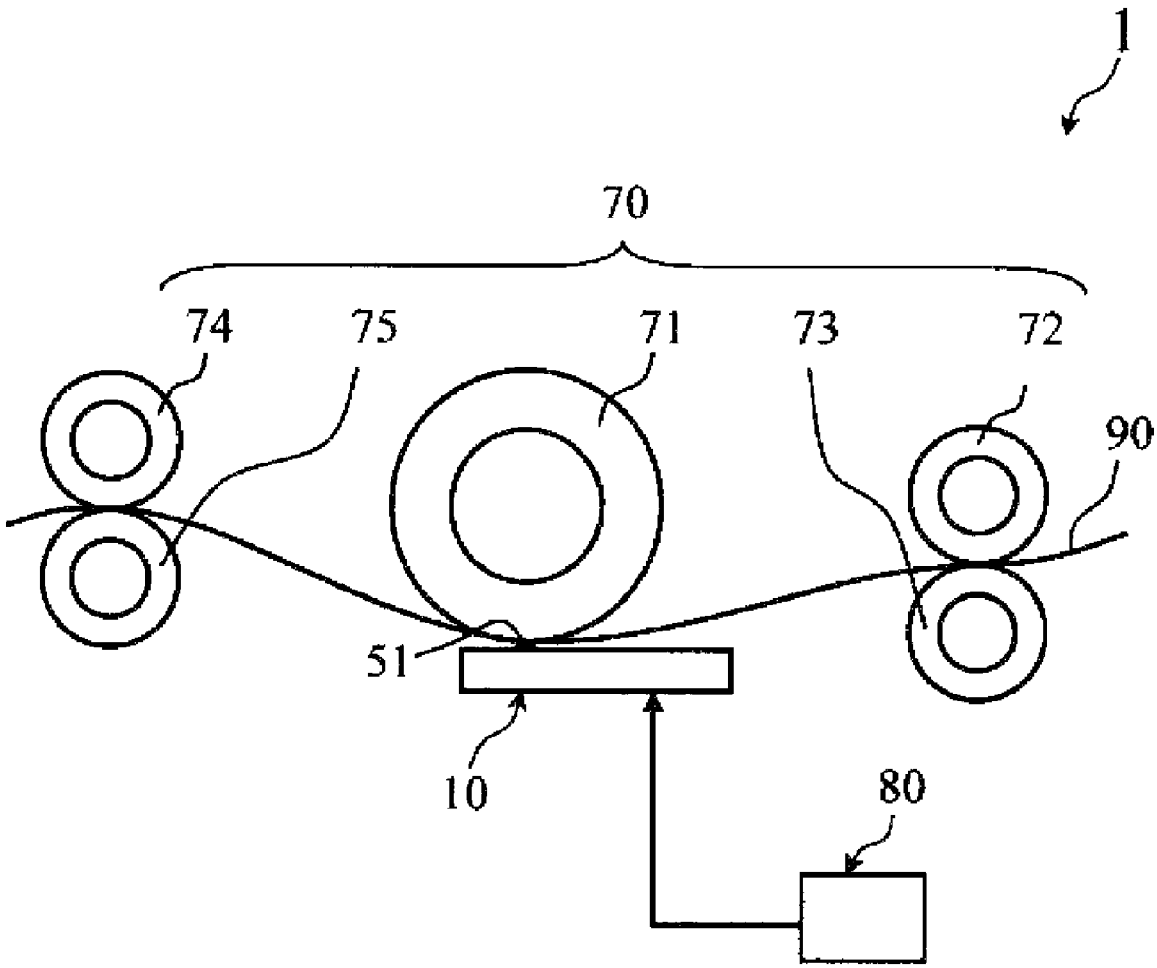
FIG. 21 is an overall view schematically illustrating the thermal printer according to an embodiment of the present disclosure.

A thermal printer 1 as a recording device according to the present disclosure is described below in conjunction with FIG. 21. FIG. 21 is an overall view schematically illustrating the thermal printer 1 according to an embodiment of the present disclosure.

The thermal printer 1 comprises the thermal head 10, a conveying mechanism 70, and a driving means 80. The thermal printer 1 is for printing on a recording medium 90 conveyed in the direction of the arrow D1. Examples used for the recording medium 90 comprise thermal paper or thermal film, in which the contrast of the surface is varied by heating, and ink film or transfer paper, in which an image is formed by transferring ink components melted by heat conduction. The present embodiment is described employing the thermal head 10, but the thermal head 10A, the thermal head 10B, the thermal head 10C, or the thermal head 10D may also be employed.

The conveying mechanism 70 is operable to convey the recording medium 90 in the direction of the arrow D3 and coming into contact with the recording medium 90 with the protective layer 60 located on the heat-generating portion 51 of the thermal head 10. The conveying mechanism 70 may comprise a platen roller 71 and conveying rollers 72, 73, 74, 75.

The platen roller 71 is operable to press and slide the recording medium 90 against the protective layer 60 located on the heat-generating portion 51. The platen roller 71 is rotatably supported in a state in which it comes into contact with the protective layer 60 located on the heat-generating portion 51. In addition, the platen roller 71 may comprise a columnar base substance coated with an elastic member on the outer surface thereof.

The conveying rollers 72, 73, 74, 75 are operable to convey the recording medium 90 along a predetermined path. That is, the conveying rollers 72, 73, 74, 75 can supply the recording medium between the heat-generating portion 51 of the thermal head 10 and the platen roller 71 and pulling the recording medium 90 out from between the heat-generating portion 51 of the thermal head 10 and the platen roller 71. These conveying rollers 72, 73, 74, 75 may comprise metal columnar members or configured a columnar base substance coated with an elastic member on the outer surface thereof in a manner similar to the platen roller 71.

The driving means 80 is operable to input electric signals driving the heat-generating portion 51 in order to make the heat-generating portion 51 selectively generate heat. That is, the driving means 80 is for supplying image information to the driver IC 12 via the external connection member 13.

Because the thermal printer 1 comprises the thermal head 10, 10A, 10B, 10C or 10D, it can benefit from the advantages of the thermal head 10, 10A, 10B, 10C or 10D. That is, the thermal printer 1 can form an improved image.

While embodiments of the present disclosure have been described above, the present disclosure is not limited to these embodiments, and various modifications can be made without departing from the scope of the present disclosure.

The base substance 11 is used for the thermal head 10, but the head is not limited to such a structure and may be an ink-jet head comprising a top plate with holes, for example. In this case, the fluidity of the ink can be increased by reducing irregularities.

While the substrate 20 according to the present embodiment is configured as a separate part from the heat storage layer 30, it is not limited to such a structure, and the heat storage layer may be integrally configured with the substrate as a glazed substrate, for example.

While the insulating portion 42 according to the present embodiment is formed so that the upper surface on the side of the direction of the arrow D5 has a generally flat shape, it is not limited to such a structure and may be configured so that the maximum thickness of the partial region 42*a* of the insulating portion 42 is thicker than the thickness of the conductive portion 41 adjacent to the partial region 42*a*, for example. In the case of such a configuration, the heat generated in the heat-generating portion 51 during pressing and conveying of the recording medium 90 by the platen roller 71 can be transferred efficiently.

Figure 22:
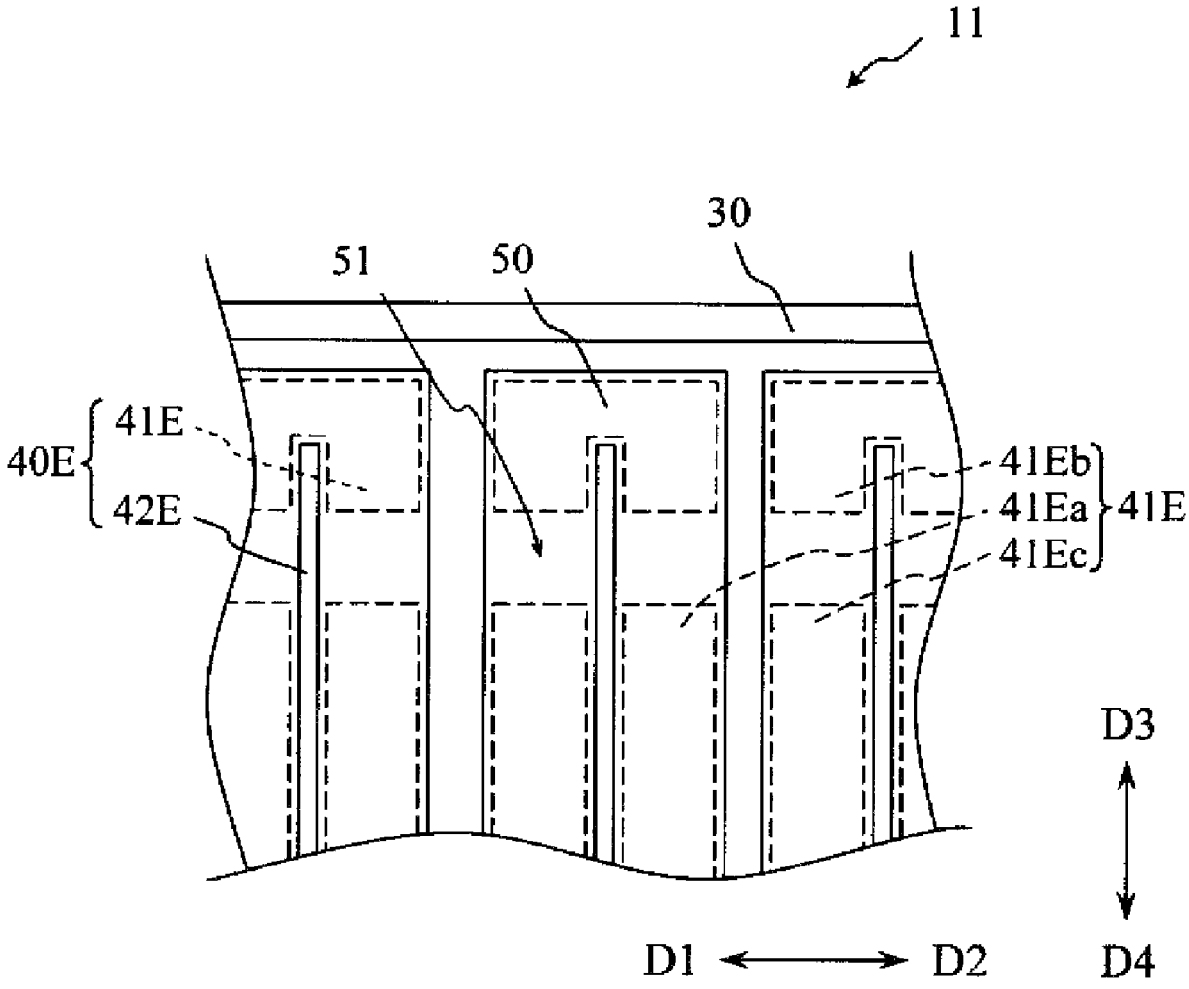
FIG. 22 is a plan view schematically illustrating an exemplary conductive pattern layer according to an embodiment of the disclosure.

While the conductive pattern layer 40 according to the present embodiment comprises the conductive portion 41 and the insulating portion 42, it is not limited to such a structure, and as shown in FIG. 22, a conductive pattern layer 40E may comprise a conductive portion 41E and an insulating portion 42E, for example. The conductive portion 41E may comprise a site 41Ea electrically connected to the driver IC 12, a site 41Eb electrically connecting two heat-generating portions 51, and a site 41Ec connected to one heat-generating portion 51 and supplying power to two heat-generating portion 51, and an insulating portion 42E may be located between or among these conductive portions 41Ea, 41Eb, 41Ec.

Figure 23:
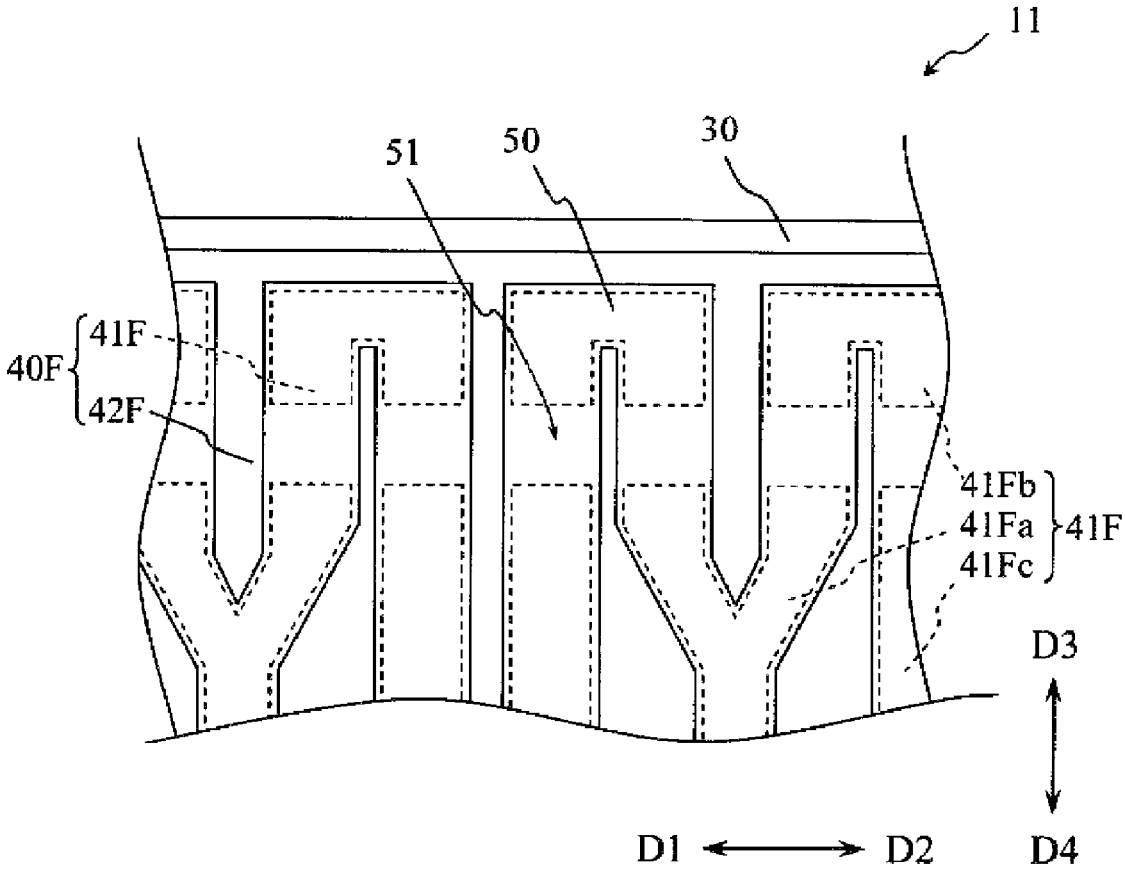
FIG. 23 is a plan view schematically illustrating an exemplary conductive pattern layer according to an embodiment.

In addition, as shown in FIG. 23, a conductive pattern layer 40F may comprise a conductive portion 41F and an insulating portion 42F. The conductive portion 41F is configured by comprising a site 41Fa electrically connected to the driver IC 12, a site 41Fb electrically connecting two heat-generating portions 51, and a site 41Fc connected to one heat-generating portion 51 and supplying power to two heat-generating portion 51, and an insulating portion 42F may be formed between these conductive portions 41Fa, 41Fb, 41Fc.

Figure 24:
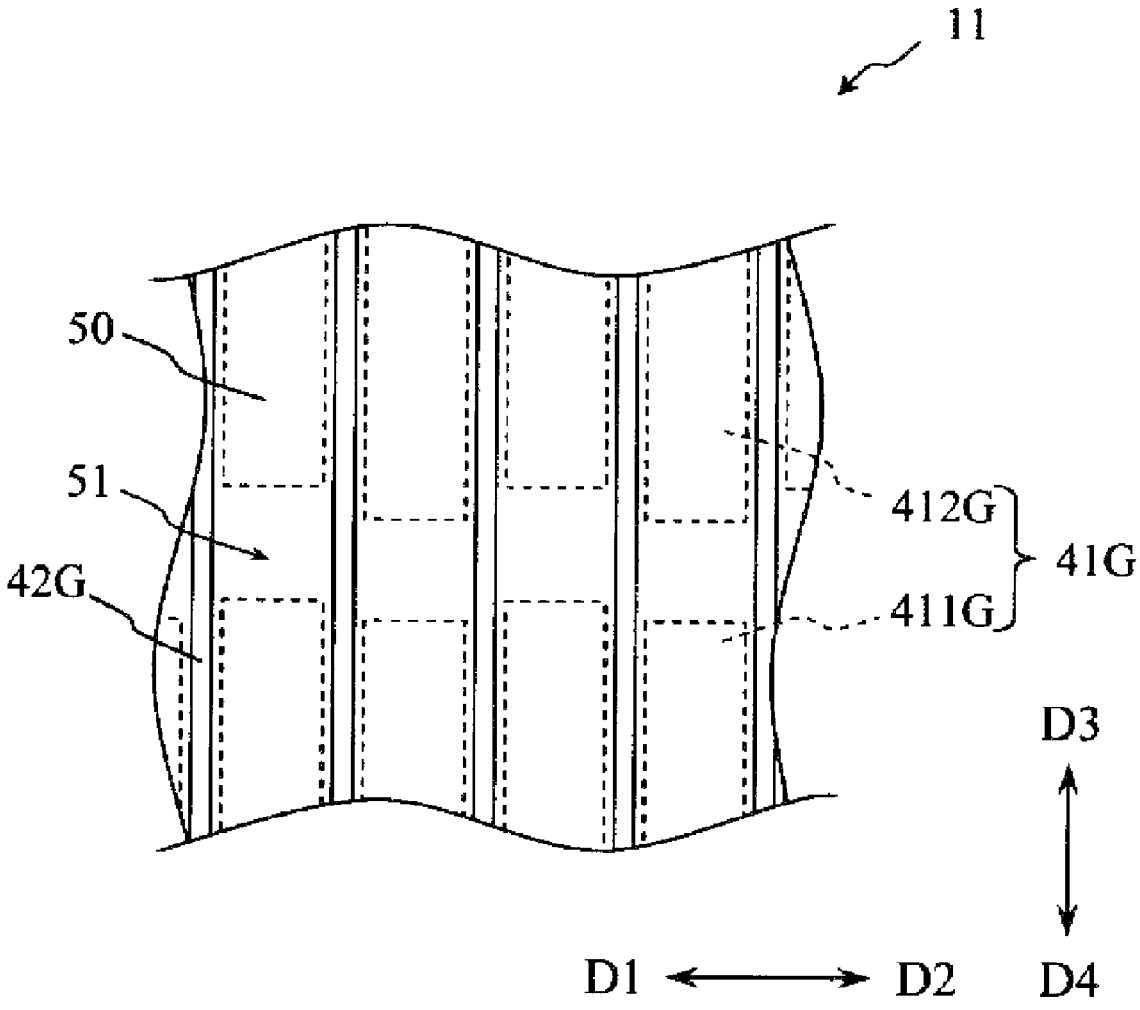
FIG. 24 is a plan view schematically illustrating an exemplary conductive pattern layer according to an embodiment.

In the first portion 41 according to the present embodiment, the end on the side of the direction of the arrow D3 extends along the arrowed directions D1, D2, but it is not limited to such a configuration. For example, as shown in FIG. 24, the position in the arrowed directions D3, D4 of the end on the side of the direction of the arrow D3 of the adjacent first portion 41G is different. Here, although it is described by using the first portion 41G as an example, the same is true for a second portion 42G.

The partial region 42*a* of the insulating portion 42 according to the present disclosure may have internal cavities, and in the case of such a configuration, because heat transfer to the side of the substrate 20 can be reduced by the cavities, the efficiency of use of the heat generated in the heat-generating portion 51 can be increased.

Figure 25A:
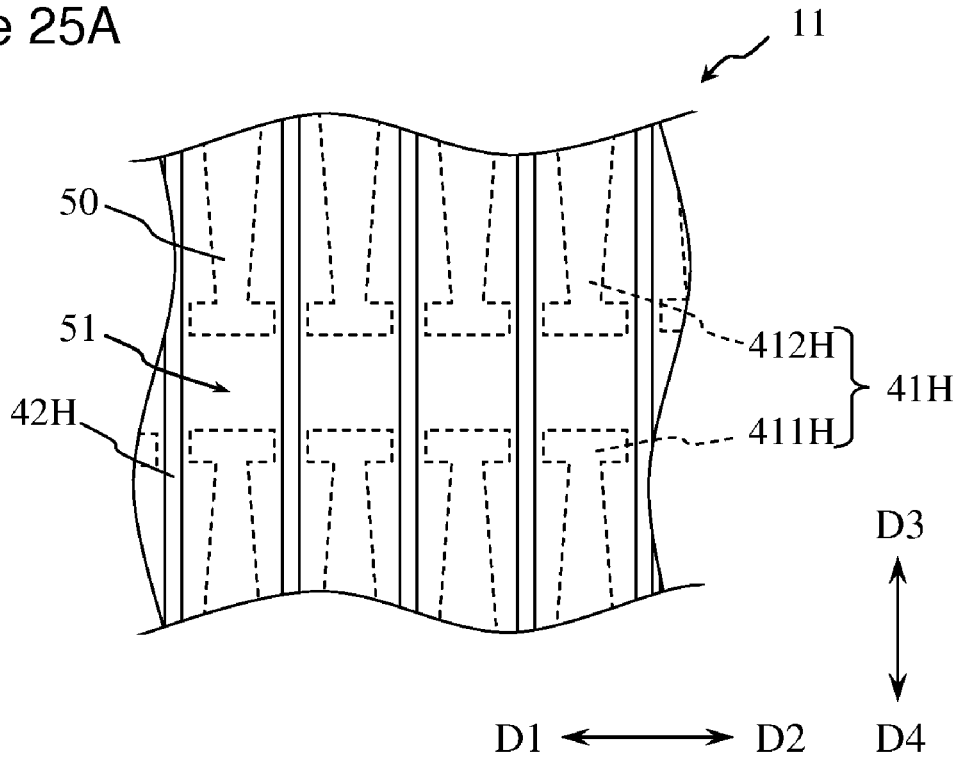
FIG. 25A is a plan view schematically illustrating an exemplary conductive pattern layer according to an embodiment.
Figure 25B:
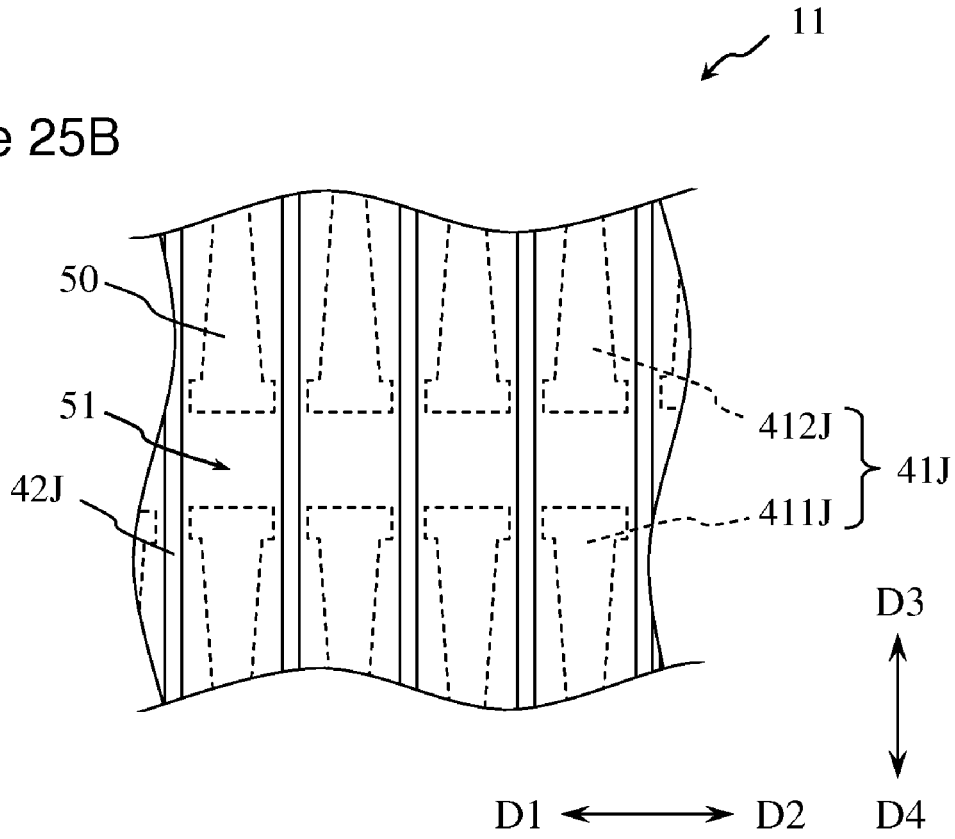
FIG. 25B is a plan view schematically illustrating an exemplary conductive pattern layer according to an embodiment.

In the first narrow-width region 411Bb according to the present embodiment, the end in the arrowed directions D1, D2 extends along the arrowed directions D3, D4, but it is not limited to such a configuration. For example, as shown in FIGS. 25A and B, the width in the arrowed directions D1, D2 is narrowed or widened as it approaches the heat-generating portion 51. In particular, if the width of the first narrow-width region is narrowed as it approaches the heat-generating portion, heat radiation via the first narrow-width region can be reduced. In addition, although it is described by using the first narrow-width region as an example, similar effects can be enjoyed even with the second narrow-width region.

Figure 26:
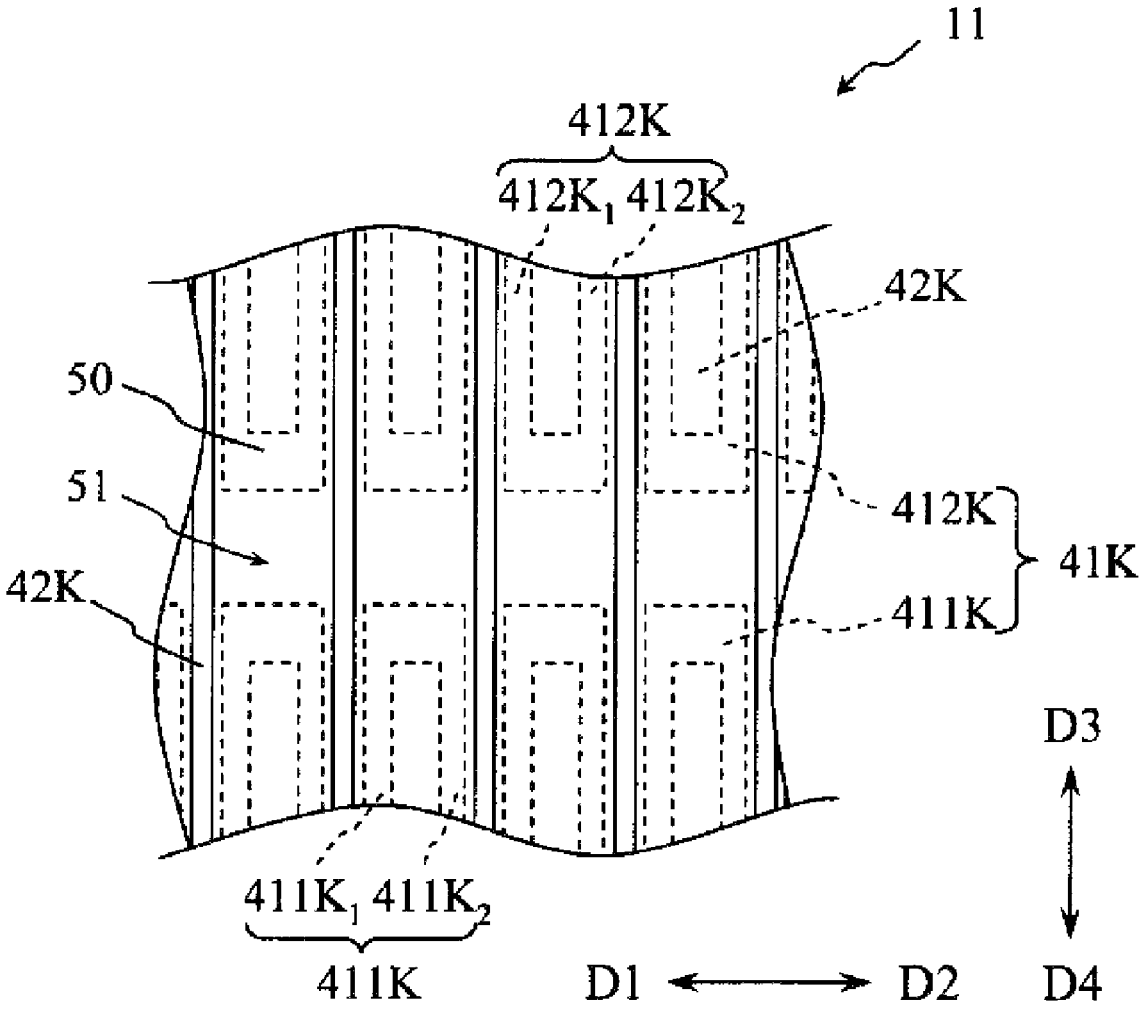
FIG. 26 is a plan view schematically illustrating an exemplary conductive pattern layer according to an embodiment.

While the first narrow-width region 411Bb is configured as a conductor having a single conductive path, it is not limited to such a configuration. For example, as shown in FIG. 26, a thermal head 11K may comprise a first conductive path 411$K_1$ and a second conductive path 411$K_2$, and an insulating portion 42K may be located between the first conductive path 411$K_1$ and the second conductive path 411$K_2$.

Figure 27A:
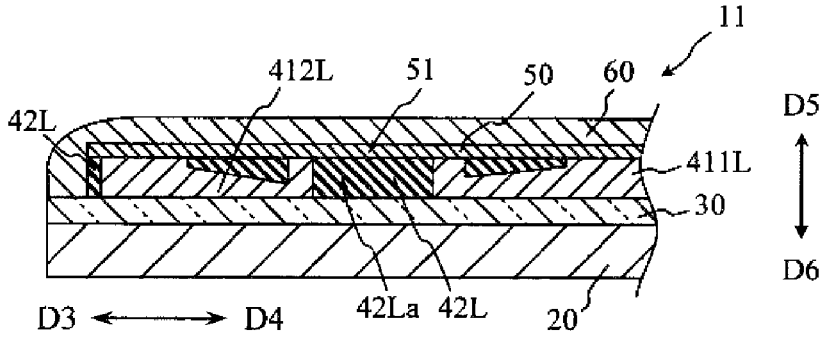
FIG. 27A is a cross-sectional view schematically illustrating an exemplary conductive pattern layer according to an embodiment.
Figure 27B:
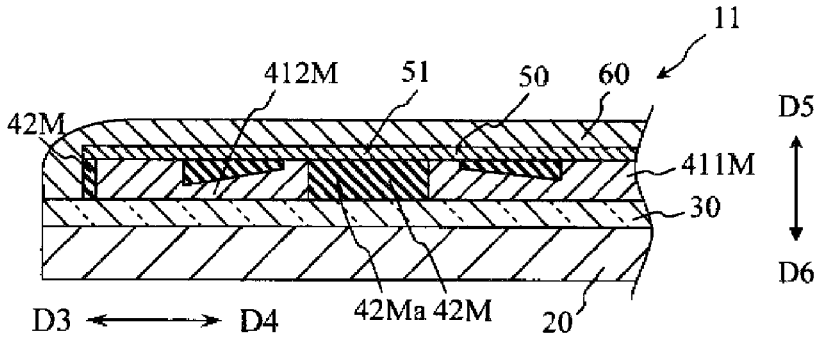
FIG. 27B is a cross-sectional view schematically illustrating an exemplary conductive pattern layer according to an embodiment.

In the first narrow-width region 411Cb in the above embodiment, the upper and lower surfaces on the arrowed directions D5, D6 extend along the arrowed directions D3, D4, but it is not limited to such a configuration. For example, as shown in FIGS. 27A and B, the thickness in the arrowed directions D5, D6 is thickened or thinned as it approaches the heat-generating portion 51. In particular, if the thickness of the first narrow-width region is narrowed as it approaches the heat-generating portion, heat radiation via the first narrow-width region can be reduced. In addition, although it is described by using the first narrow-width region as an example, similar effects can be enjoyed even with the second narrow-width region.

While the thermal head 10D according to the present embodiment is manufactured by anodizing each of the first conductive film 40Dax and the second conductive film 40Dbx individually, it is not limited to such a method of manufacturing. For example, it may be manufactured by forming the second conductive film with materials with a lower tendency toward ionization than the first conductive film and anodizing these laminated films together.

However, when the thermal head 10B is employed in a thermal printer, the cross-sectional area in the planar direction configured by the arrowed directions D1, D2 and the arrowed directions D5, D6 is different between the first portion 411B and the second portion 412B. Specifically, the width $W_{12b}$ of the second narrow-width region 412Bb is different from the width $W_{11b}$ of the first narrow-width region 411Bb. As a result, in the thermal printer employing the thermal head 10B, the site with the highest temperature when the heat-generating portion 51 is caused to generate heat (hereafter referred to as "heat spot") can be shifted from the center of the heat-generating portion 51, and the heat spot can be placed at a preferred location for transferring heat.

In addition, the second portion 412B of the thermal head 10B has a larger cross-sectional area in the planar direction configured by the arrowed directions D1, D2 and the arrowed directions D5, D6 than the first portion 411B. Specifically, it is configured so that the width $W_{12b}$ of the second narrow-width region 412Bb is wider than the width $W_{11b}$ of the first narrow-width region 411Bb. As a result, in the thermal head 10B, the heat spot can be located on the side of the first portion 411 from the center of the heat-generating portion 51. Consequently, in the thermal printer employing the thermal head 10B, even when an ink ribbon and plain paper used as the recording medium 90 are pressed on the heat-generating portion 51 by the platen roller 71 to make a transfer to the plain paper, for example, the plain paper is transferred to after the ink is sufficiently melted.

Here, although the present disclosure is described by using a case of employing the thermal head 10B for a thermal printer as an example, the advantages with respect to two heat spots as described above are not limited to cases of employing the thermal head 10B. For example, similar advantages can be enjoyed even when the thermal head 10C or the thermal head 10D is employed for the thermal printer.

While at least one exemplary embodiment has been presented in the foregoing detailed description, the present disclosure is not limited to the above-described embodiment or embodiments. Variations may be apparent to those skilled in the art. In carrying out the present disclosure, various modifications, combinations, sub-combinations and alterations may occur in regard to the elements of the above-described embodiment insofar as they are within the technical scope of the present disclosure or the equivalents thereof. The exemplary embodiment or exemplary embodiments are examples, and are not intended to limit the scope, applicability, or configuration of the disclosure in any way. Rather, the foregoing detailed description will provide those skilled in the art with a template for implementing the exemplary embodiment or exemplary embodiments. It should be understood that various changes can be made in the function and arrangement of elements without departing from the scope of the disclosure as set forth in the appended claims and the legal equivalents thereof. Furthermore, although embodiments of the present disclosure have been described with reference to the accompanying drawings, it is to be noted that changes and modifications may be apparent to those skilled in the art. Such changes and modifications are to be understood as being comprised within the scope of the present disclosure as defined by the claims.

Terms and phrases used in this document, and variations hereof, unless otherwise expressly stated, should be construed as open ended as opposed to limiting. As examples of the foregoing: the term "comprising" should be read as mean "comprising, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the present disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

The invention claimed is:

1. A recording head comprising:

a substrate;

a conductive pattern layer formed on the substrate, and comprising:

one or more first conductive portions;

one or more second conductive portions, each paired with one of the first conductive portions;

and an insulating portion insulating the first conductive portions and the second conductive portions; and one or more electrical resistance layers on the conductive pattern layer:

each connected to one of the first conductive portions and one of the second conductive portions; and comprising a heat-generating region between the first conductive portions and the second conductive portions, wherein the maximum thickness of the insulating portion located under the heat-generating region is larger than a thickness of the first conductive portions and a thickness of the second conductive portions, wherein the insulating portion located under the heat-generating region is gradually thinned from the center of the heat-generating region toward the first conductive portion and the second conductive portion.

2. The recording head according to claim 1, wherein the insulating portion located under the heat-generating region comprises a cavity inside.

3. The recording head according to claim 1, wherein the hardness of the insulating portion located under the heat-generating region is greater than that of the first conductive portion and that of the second conductive portion.

4. The recording head according to claim 1, wherein the first conductive portion and the second conductive portion each have a higher thermal conductivity than the insulating portion, and the clearance between the first conductive portion and the second conductive portion is gradually shortened from the upper side toward the lower side in the thickness direction.

5. The recording head according to claim 1, wherein the average thickness of the electrical resistance layer is smaller than that of the first conductive portion and that of the second conductive portion.

6. The recording head according to claim 1, wherein at least one of the first conductive part and the second conductive part comprises a narrow-width region where the width is smaller than a width of the heat-generating area when observed from a planar view.

7. The recording head according to claim 1, wherein at least one of the first conductive part and the second conductive part comprises a thin-layer region thinner than other regions.

8. The recording head according to claim 1, wherein the conductive pattern layer comprises a plurality of the first conductive portions and a part of the insulating portion extends between two of the plurality of the first conductive portions.

9. The recording head according to claim 8, wherein the part of the insulating portion extends upward in the thickness direction of the first conductive portions.

10. The recording head according to claim 8, wherein the plurality of the first conductive portions is surrounded by the substrate, the insulating portion, and the electrical resistance layer.

11. The recording head according to claim 8, wherein the plurality of the first conductive portions has higher thermal conductivity than the insulating portion, and the clearance between one first conductive portion of the plurality of first conductive portions and another first conductive portion adjacent to the one first conductive portion is gradually shortened from the upper side toward the lower side in the thickness direction.

12. The recording head according to claim 8, wherein the plurality of the second conductive portions is connected to a plurality of the heat-generating regions respectively and has a lower thermal capacity than the plurality of first conductive portions.

13. A recording device, comprising:

the recording head according to claim 1; and a conveying mechanism for conveying a recording medium onto the heat-generating region of the recording head.

* * * * *